US011615754B2

(12) United States Patent
Koide

(10) Patent No.: US 11,615,754 B2
(45) Date of Patent: Mar. 28, 2023

(54) DISPLAY DEVICE

(71) Applicant: Japan Display Inc., Tokyo (JP)

(72) Inventor: Gen Koide, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 17/838,640

(22) Filed: Jun. 13, 2022

(65) Prior Publication Data

US 2022/0398984 A1 Dec. 15, 2022

(30) Foreign Application Priority Data

Jun. 15, 2021 (JP) ..... JP2021-099691

(51) Int. Cl.
*G09G 3/34* (2006.01)

(52) U.S. Cl.
CPC ..... *G09G 3/344* (2013.01); *G09G 2330/021* (2013.01)

(58) Field of Classification Search
None
See application file for complete search history.

(56) References Cited

U.S. PATENT DOCUMENTS 8,937,616 B2 * 1/2015 Yamazaki ..... G09G 3/344 345/212
2003/0034950 A1 * 2/2003 Liang ..... G02F 1/167 345/107
2006/0262081 A1 * 11/2006 Zhou ..... G09G 3/344 345/107
2009/0237392 A1 * 9/2009 Kajino ..... G09G 3/344 345/107
2010/0073282 A1 * 3/2010 Murayama ..... G09G 3/035 345/107
2011/0248909 A1 * 10/2011 Sato ..... G02F 1/1676 345/107
2012/0162186 A1 * 6/2012 Kim ..... G02F 1/167 345/212
2016/0042695 A1 * 2/2016 Park ..... G09G 3/3648 345/690
2019/0129269 A1 5/2019 Ogawa

FOREIGN PATENT DOCUMENTS

JP 2019086544 A 6/2019

* cited by examiner

*Primary Examiner* — Dorothy Harris
(74) *Attorney, Agent, or Firm* — K&L Gates LLP

(57) ABSTRACT

A display device includes: a first pixel transistor couples one electrode of holding capacitance to a first signal line; a second pixel transistor couples another electrode of the holding capacitance to a second signal line; a third pixel transistor couples the other electrode of the holding capacitance to a GND potential; and a driver that supplies a negative potential to the second signal line when the first signal line is supplied with a positive potential, supplies the GND potential to the second signal line when the first signal line is supplied with the GND potential, and supplies the positive potential to the second signal line when the first signal line is supplied with the negative potential. The first and second pixel transistors are on during a writing period and off during a holding period. The third pixel transistor is off during the writing period and on during the holding period.

7 Claims, 25 Drawing Sheets

DISPLAY DEVICE

CROSS-REFERENCE TO RELATED APPLICATION

This application claims the benefit of priority from Japanese Patent Application No. 2021-099691 filed on Jun. 15, 2021, the entire contents of which are incorporated herein by reference.

BACKGROUND

1. Technical Field

What is disclosed herein relates to a display device.

2. Description of the Related Art

Recent years have seen a growing demand for display devices for use in mobile electronic apparatuses, such as mobile phones and electronic paper displays. For example, in electrophoretic displays (EPDs) used in the electronic paper displays, a pixel has a memory property to hold a potential at the time of rewriting. After the rewriting is performed once for each frame, the memory property holds the potential at the time of the rewriting until the rewriting is performed for the next frame. As a result, the EPDs can perform low power consumption driving. For example, a technology to achieve the low power consumption is disclosed in which a pixel transistor is configured to have a complementary metal-oxide semiconductor (CMOS) configuration obtained by combining a p-channel transistor with an n-channel transistor.

In the EPD, a source drive signal at a high voltage is generally applied to the source of the pixel transistor, which increases the chip size due to an increase in withstand voltage of a display integrated circuit (IC), and may lead to an increase in cost and power consumption. In addition, a substrate is also required to have a high withstand voltage. Therefore, securement of reliability is an issue.

For the foregoing reasons, there is a need for a display device that can achieve a lower withstand voltage and can achieve lower cost and improved reliability.

SUMMARY

According to an aspect, a display device having a writing period of charging holding capacitance in a pixel and a holding period of holding the holding capacitance charged in the writing period, includes: a first pixel transistor configured to electrically couple one electrode of the holding capacitance to a first signal line; a second pixel transistor configured to electrically couple another electrode of the holding capacitance to a second signal line; a third pixel transistor configured to electrically couple the other electrode of the holding capacitance to a ground (GND) potential; and a driver configured to supply one of a positive potential, the GND potential, and a negative potential to the first signal line and the second signal line. The driver is configured to: supply the negative potential to the second signal line when the first signal line is supplied with the positive potential; supply the GND potential to the second signal line when the first signal line is supplied with the GND potential; and supply the positive potential to the second signal line when the first signal line is supplied with the negative potential. The first pixel transistor and the second pixel transistor are configured to be placed in an on state during the writing period and placed in an off state during the holding period. The third pixel transistor is configured to be placed in the off state during the writing period and placed in the on state during the holding period.

DETAILED DESCRIPTION

Figure 1:
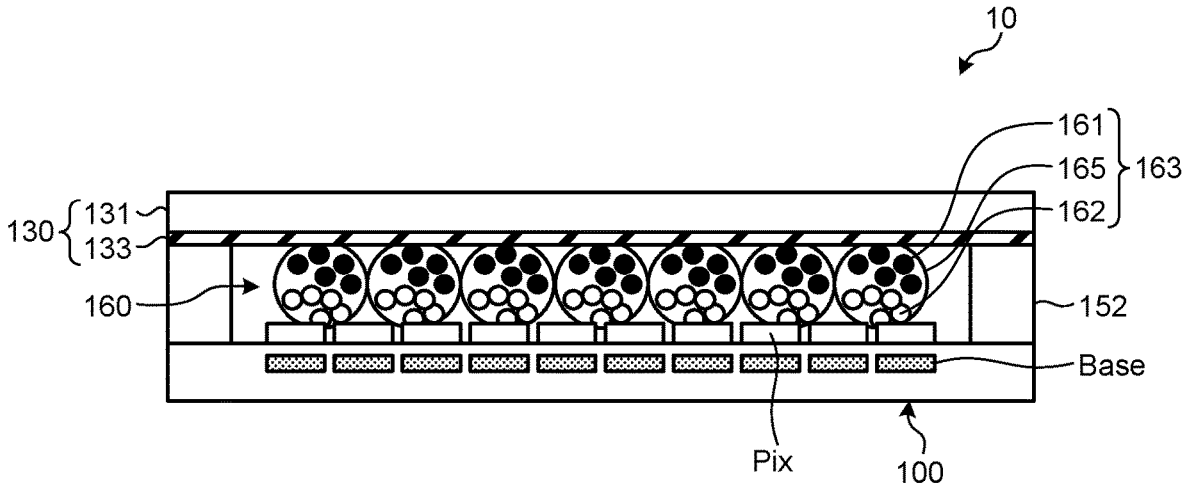
FIG. 1 is a sectional view illustrating a configuration example of a display device according to an embodiment.

The following describes modes (embodiments) for carrying out the present disclosure in detail with reference to the drawings. The present disclosure is not limited by the description of the embodiments given below. Components described below include those easily conceivable by those skilled in the art or those substantially identical thereto. Moreover, the components described below can be combined as appropriate. The disclosure is merely an example, and the present disclosure naturally encompasses appropriate modifications easily conceivable by those skilled in the art while maintaining the gist of the disclosure. To further clarify the description, the drawings schematically illustrate widths, thicknesses, shapes, and other properties of various parts as compared with actual aspects thereof, in some cases. However, they are merely examples, and interpretation of the present disclosure is not limited thereto. The same element as that illustrated in a drawing that has already been discussed is denoted by the same reference numeral through the description and the drawings, and detailed description thereof will not be repeated in some cases where appropriate.

First, a structure of a display device 10 according to an embodiment will be described. FIG. 1 is a sectional view illustrating a configuration example of the display device according to the embodiment.

In the example illustrated in FIG. 1, the display device 10 is, for example, an electrophoretic device (electrophoretic display (EPD)) provided with an electrophoretic display panel having an electrophoretic layer. As illustrated in FIG. 1, the display device 10 according to the embodiment includes a thin-film transistor (TFT) substrate 100, a counter substrate 130 disposed so as to face the TFT substrate 100, an electrophoretic layer (functional layer) 160 disposed between the TFT substrate 100 and the counter substrate 130, and a sealing part 152.

The TFT substrate 100 is provided with pixel electrodes Pix and holding electrodes Base. In a comparative example described later, the holding electrodes Base are supplied with a common potential VCOM.

The counter substrate 130 includes a base material 131 and a counter electrode 133. The base material 131 is a light-transmitting glass substrate, a light-transmitting resin substrate, or a light-transmitting resin film. The counter electrode 133 is provided on a surface side of the base material 131 facing the TFT substrate 100. The counter electrode 133 is formed of indium tin oxide (ITO) serving as a light-transmitting conductive film. The counter electrode 133 faces the pixel electrodes Pix with the electrophoretic layer 160 interposed therebetween. The counter electrode 133 is supplied with the common potential VCOM.

The sealing part 152 is provided between the TFT substrate 100 and the counter substrate 130. The electrophoretic layer 160 is sealed in an internal space surrounded by the TFT substrate 100, the counter substrate 130, and the sealing part 152.

The electrophoretic layer 160 includes a plurality of microcapsules 163. Each of the microcapsules 163 encapsulates a plurality of black particles 161, a plurality of white particles 162, and a dispersion liquid 165. The black particles 161 and the white particles 162 are dispersed in the dispersion liquid 165. The dispersion liquid 165 is a light-transmitting liquid, such as silicone oil. The black particles 161 are electrophoretic particles made using, for example, negatively charged graphite. The white particles 162 are electrophoretic particles made using, for example, positively charged titanium dioxide ($TiO_2$).

An electric field generated between each of the pixel electrodes Pix and the counter electrode 133 changes the dispersion state of the black particles 161 and the white particles 162. The state of light transmission through the electrophoretic layer 160 changes depending on the dispersion state of the black and the white particles 161 and 162. Thus, an image is displayed on a display surface. For example, when the common potential VCOM (at, for example, a ground (GND) potential) is supplied to the counter electrode 133 and a negative potential is supplied to the pixel electrode Pix, the negatively charged black particles 161 move toward the counter substrate 130, and the positively charged white particles 162 move toward the TFT substrate 100. As a result, when the TFT substrate 100 is viewed from the counter substrate 130 side, an area (pixels) overlapping the pixel electrodes Pix in a plan view is displayed in black.

The display device 10 may be a monochrome display device, or may be a color display device using, for example, color filters in a plurality of colors. The display device 10 may employ a light reflecting material as the pixel electrodes of pixels PX, or may have a configuration in which light-transmitting pixel electrodes are combined with a reflective film of, for example, a metal, and the reflective film reflects light. The display device 10 may be a flexible display such as a sheet display. In the present embodiment, the electrophoretic device (electrophoretic display (EPD)) provided with the electrophoretic display panel having the electrophoretic layer has been exemplified as the display device 10. However, the present disclosure is also applicable to a case where the display device 10 is, for example, a liquid crystal display device (liquid crystal display) provided with a liquid crystal display panel having a liquid crystal layer.

Figure 2:
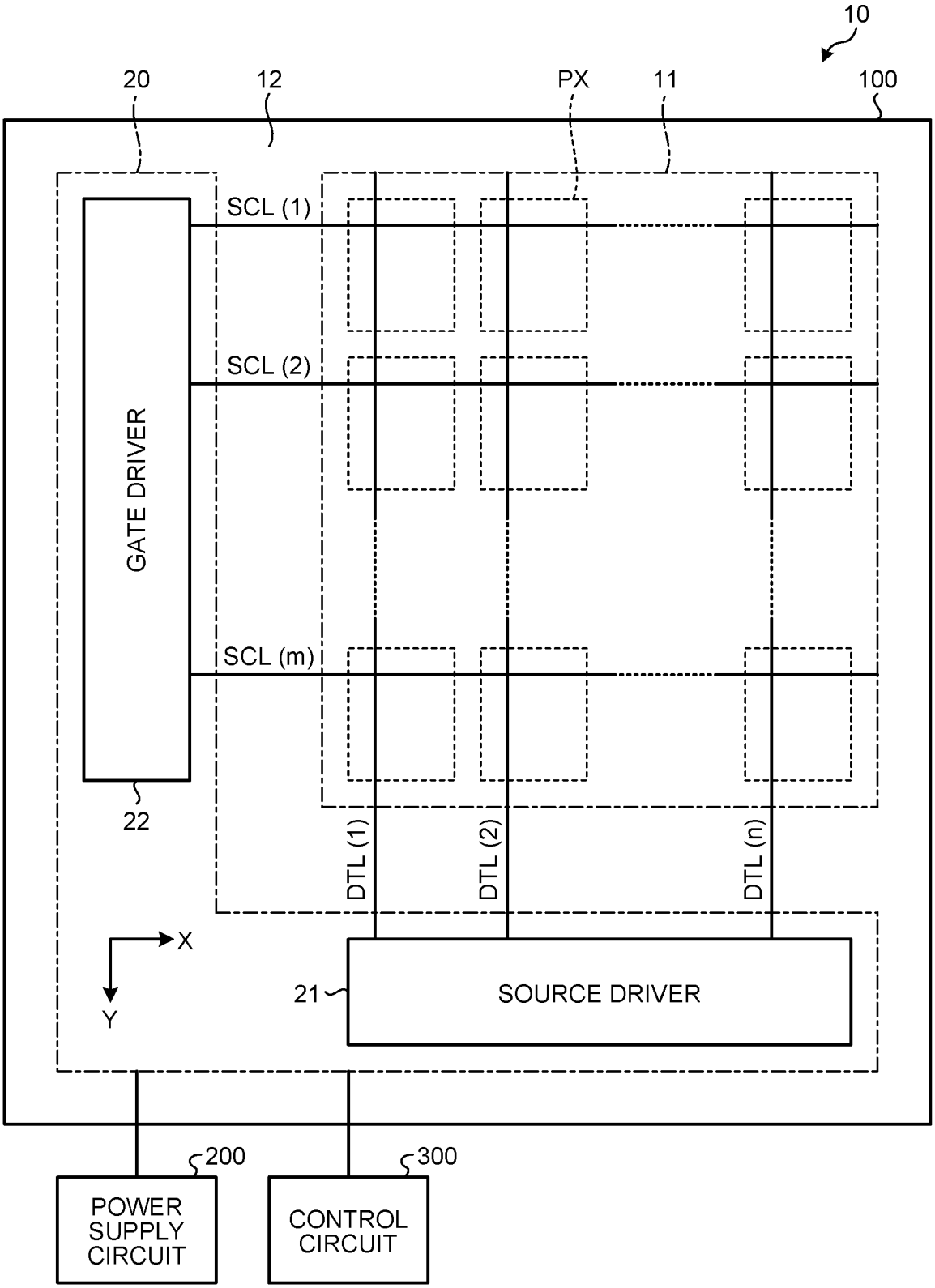
FIG. 2 is a block diagram illustrating a configuration example of the display device according to a comparative example.

Before describing a configuration of the display device 10 according to the embodiment, a configuration of the display device according to a comparative example will be described. FIG. 2 is a block diagram illustrating a configuration example of the display device according to the comparative example.

The display device 10 is mounted on, for example, an electronic apparatus (not illustrated). The display device 10 receives various power supply voltages applied from, for example, a power supply circuit 200 of the electronic apparatus and displays images based on signals output from, for example, a control circuit 300 serving as a host processor of the electronic apparatus. Examples of the electronic apparatus on which the display device 10 is mounted include electronic paper display devices.

As illustrated in FIG. 2, the display device 10 is provided with a display region 11 and a frame region 12 surrounding the display region 11 on the TFT substrate 100. The frame region 12 is provided with a display panel driver 20. In the display region 11, the pixels PX are arranged in a two-dimensional matrix having a row-column configuration in a first direction (X-direction in FIG. 2) and a second direction (Y-direction in FIG. 2) orthogonal to the first direction. Hereafter, the first direction (X-direction in FIG. 2) is also called a row direction, and the second direction (Y-direction in FIG. 2) is also called a column direction. A row in which the pixels PX are arranged in the row direction is also called a pixel row, and a column in which the pixels PX are arranged in the column direction is also called a pixel column. FIG. 2 illustrates an example in which N×M (N in the row direction and M in the column direction) of the pixels PX are arranged in a matrix.

The power supply circuit 200 is a power source generator that generates the various power supply voltages to be supplied to components of the display device 10 according to the present embodiment. The power supply circuit 200 is coupled to the display panel driver 20. The various power supply voltages are supplied from the power supply circuit 200 to the display panel driver 20.

The control circuit 300 is an arithmetic processor that controls operations of the display device 10 according to the present embodiment. The control circuit 300 is coupled to the display panel driver 20. The control circuit 300 is composed of a control IC, for example. A video signal and various control signals are supplied from the control IC to the display panel driver 20.

The display panel driver 20 includes a source driver 21 and a gate driver 22.

The display panel driver 20 causes the source driver 21 hold the video signal. The source driver 21 is electrically coupled to each of the pixels PX arranged in the Y-direction in the display region 11 through a source bus line (signal line) DTL(n) (where n is an integer from 1 to N) and transmits a source drive signal (pixel signal) SIG(n) to the source bus line (signal line) DTL(n) (refer to FIG. 3). The source drive signal (pixel signal) SIG(n) is supplied to each of the pixels PX arranged in the Y-direction.

The display panel driver 20 causes the gate driver 22 to sequentially select the pixels PX arranged in the X-direction in the display region 11. Hereinafter, in one frame period, a period in which the gate driver 22 selects the pixels PX arranged in the X-direction in the display region 11 is also called "writing period". In addition, in one frame period, a period except the writing period in which the gate driver 22 selects the pixels PX arranged in the X-direction in the display region 11 is also called "holding period".

Figure 3:
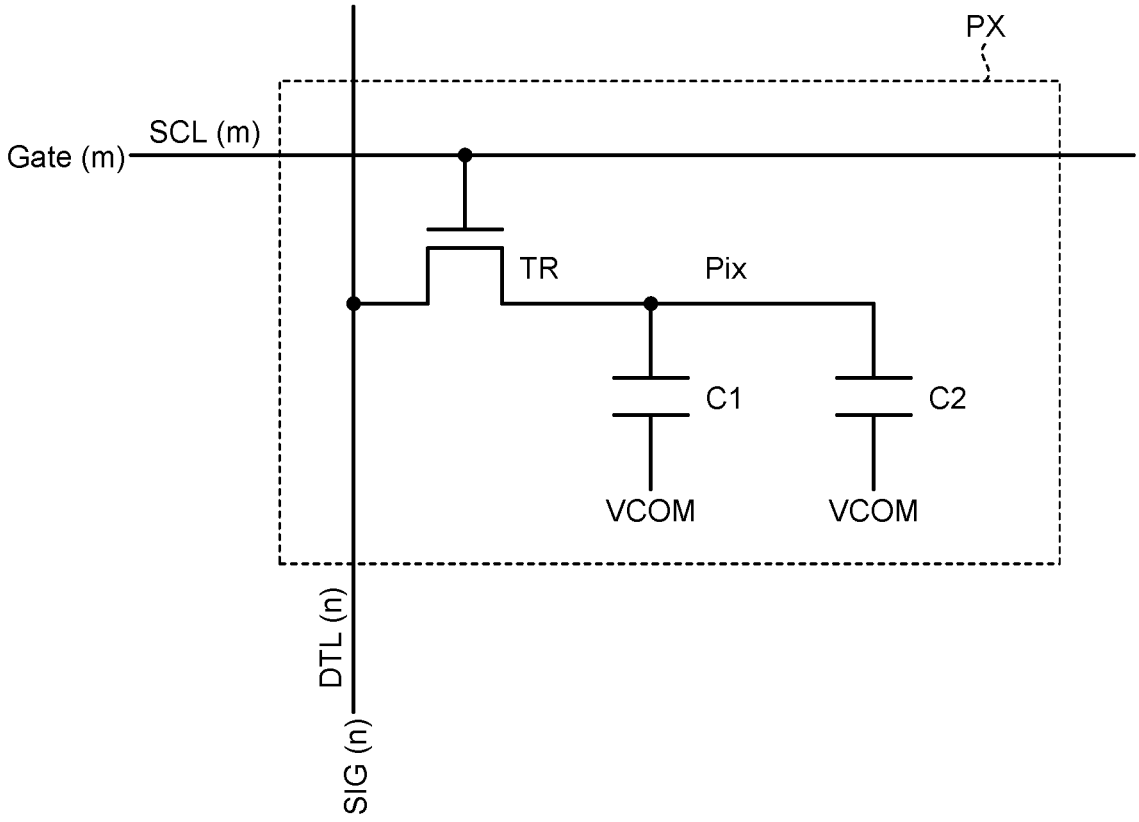
FIG. 3 is a circuit diagram illustrating a configuration example of one pixel of the display device according to the comparative example.

The gate driver 22 is electrically coupled to each of the pixels PX arranged in the X-direction in the display region 11 through a gate bus line (scan line) SCL(m) (where m is an integer from 1 to M) and sequentially selects each of the gate bus lines (scan lines) SCL(m) arranged in the Y-direction to transmit thereto a gate drive signal (scan signal) Gate(m) (refer to FIG. 3). The gate drive signal (scan signal) Gate(m) is supplied to each of the pixels PX coupled to the selected gate bus line (scan line) SCL(m).

The source driver 21 and the gate driver 22 may be provided on the TFT substrate 100 or on the counter substrate 130 (refer to FIG. 1). The source driver 21 and the gate driver 22 may be mounted on a display IC mounted on another circuit board (such as a flexible substrate) coupled to the TFT substrate 100.

FIG. 3 is a circuit diagram illustrating a configuration example of one pixel of the display device according to the comparative example.

As illustrated in FIG. 3, in the display device 10 according to the comparative example, each of the pixels PX of the TFT substrate 100 includes a pixel transistor TR. In the display device 10 according to the comparative example, the pixel transistor TR is an n-channel metal oxide semiconductor (NMOS) transistor. The gate of the pixel transistor TR is coupled to the gate bus line (scan line) SCL(m). The source pf the pixel transistor TR is coupled to the source bus line (signal line) DTL(n). The drain of the pixel transistor TR is provided with the pixel electrode Pix.

Each of the pixels PX of the TFT substrate 100 has first holding capacitance C1 and second holding capacitance C2. The first holding capacitance C1 is capacitance generated between the pixel electrode Pix and each of the holding electrodes Base (refer to FIG. 1). The second holding capacitance C2 is a capacitance generated between the counter electrode 133 of the counter substrate 130 (refer to FIG. 1) and the pixel electrode Pix. The first holding capacitance C1 is approximately 1 pF, for example. The second holding capacitance C2 is, for example, approximately 1/10 of the first holding capacitance C1.

The pixel electrode Pix is supplied with the source drive signal (pixel signal) from the source bus line (signal line) DTL(n) through the pixel transistor TR. In the display device 10 according to the comparative example, the holding electrodes Base and the counter electrode 133 are supplied with the common potential VCOM. The potential of the source drive signal (pixel signal) supplied to the pixel electrode Pix is held by the first holding capacitance C1 and the second holding capacitance C2.

Figure 4A:
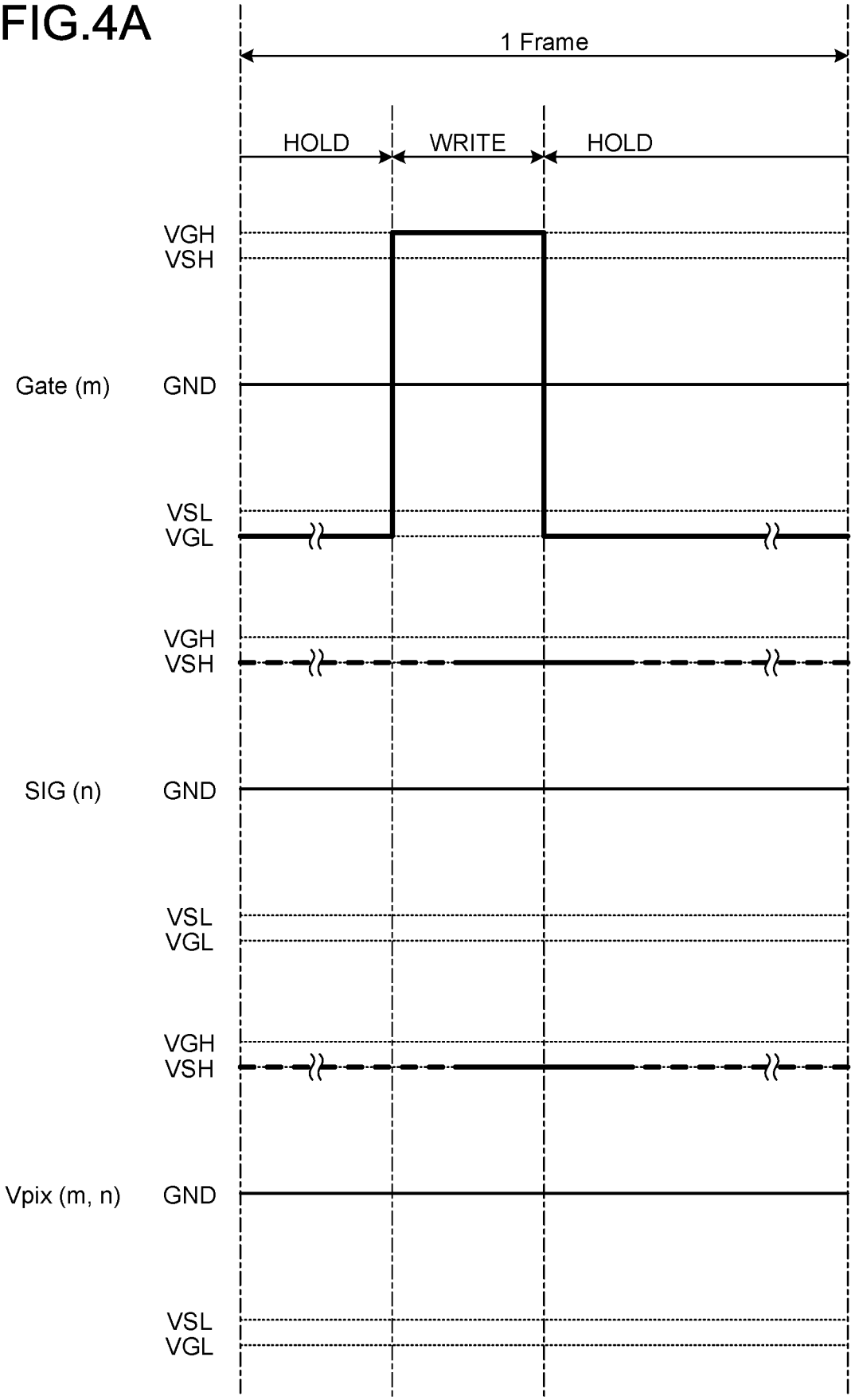
FIG. 4A is a timing diagram for explaining an operation in the comparative example.
Figure 4B:
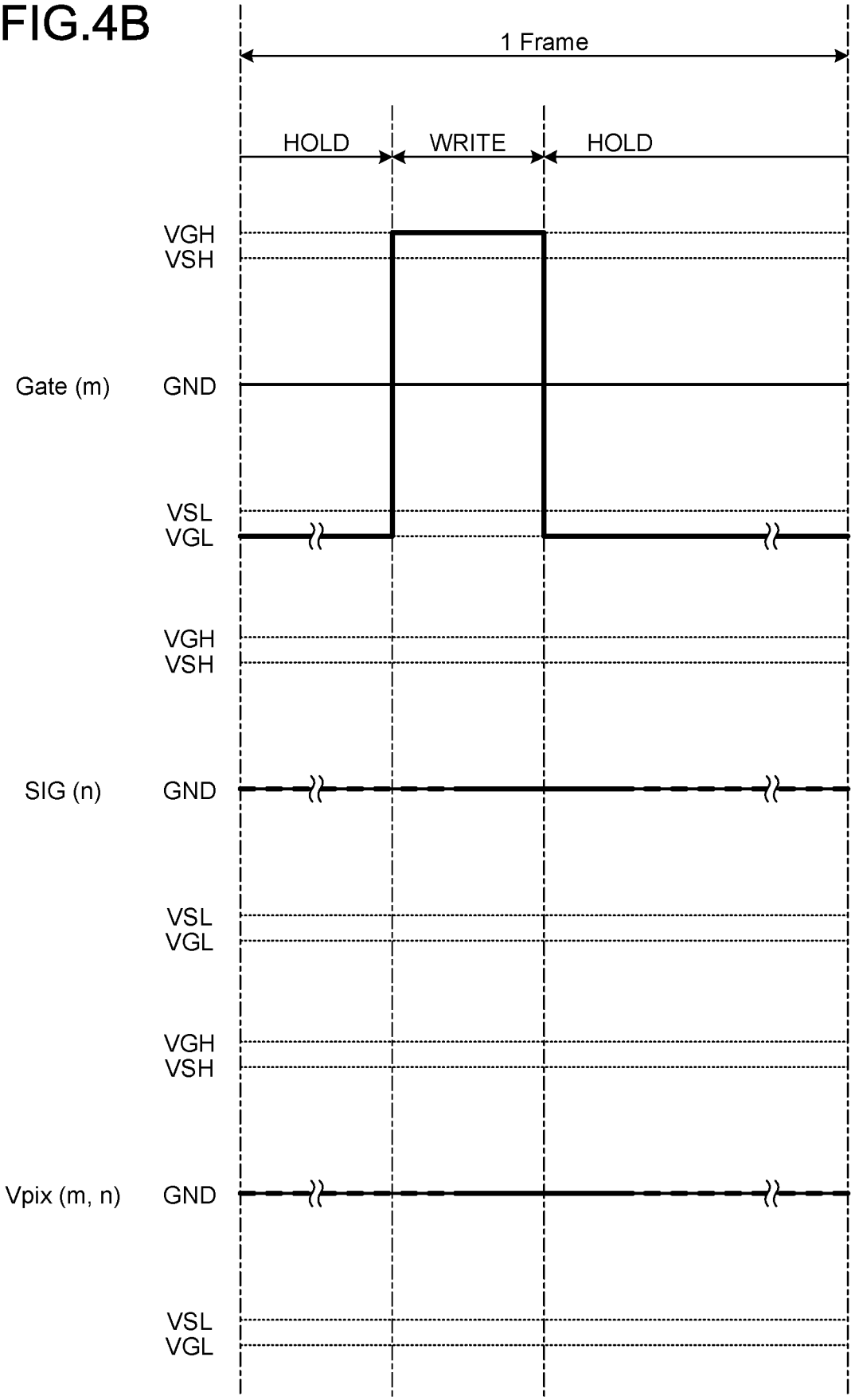
FIG. 4B is a timing diagram for explaining another operation in the comparative example.
Figure 4C:
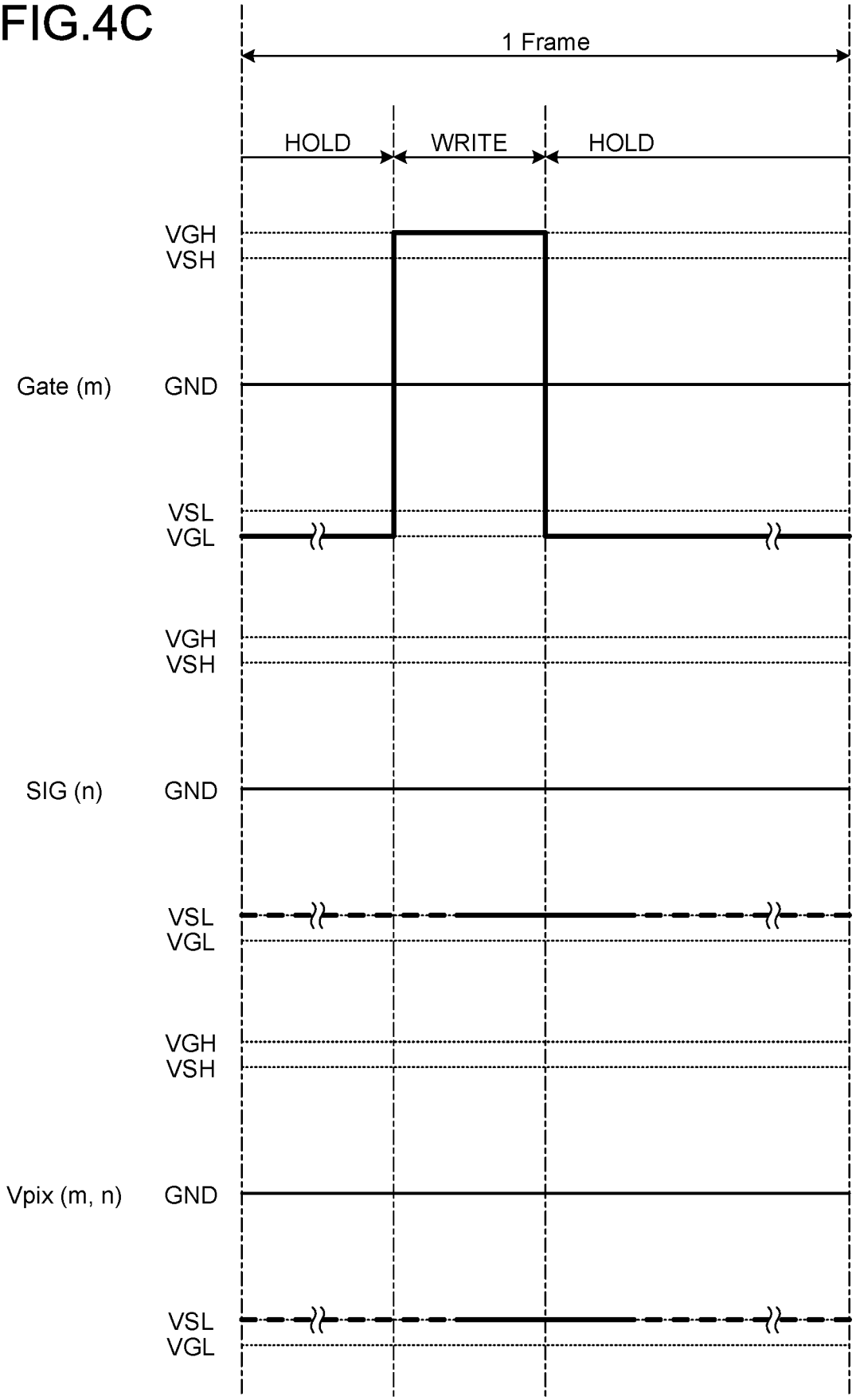
FIG. 4C is a timing diagram for explaining still another operation in the comparative example.

FIGS. 4A, 4B, and 4C are timing diagrams for explaining operations in the comparative example.

As illustrated in FIGS. 4A, 4B, and 4C, the gate driver 22 supplies a positive gate potential VGH to the gate bus line (scan line) SCL(m) during the writing period of each of the pixels PX in the m-th row. The gate driver 22 supplies a negative gate potential VGL to the gate bus line (scan line) SCL(m) during the holding period other than the writing period.

As illustrated in FIG. 4A, when the source bus line (signal line) DTL(n) is supplied with a positive source potential VSH that is a lower potential than the positive gate potential VGH, that is, when the source drive signal (pixel signal) SIG(n) is set to the positive source potential VSH, supplying the positive gate potential VGH to the gate bus line (scan line) SCL(m) during the writing period of the pixels PX in the m-th row controls to turn on the pixel transistor TR of each pixel PX in the m-th row (refer to FIG. 3) to apply the positive source potential VSH as a potential Vpix(m, n) of the pixel electrode Pix of the pixel PX in the m-th row and the n-th column. During the holding period following the writing period, the potential Vpix(m, n) of the pixel electrode Pix of the pixel PX in the m-th row and the n-th column is held at the positive source potential VSH by the first holding capacitance C1 and the second holding capacitance C2.

As illustrated in FIG. 4B, when the source bus line (signal line) DTL(n) is supplied with the GND potential, that is, when the source drive signal (pixel signal) SIG(n) is set to the GND potential, supplying the GND potential to the gate bus line (scan line) SCL(m) during the writing period of the pixels PX in the m-th row controls to turn on the pixel transistor TR of the pixel PX in the m-th row (refer to FIG. 3), and the GND potential is applied as the potential Vpix(m, n) of the pixel electrode Pix of the pixel PX in the m-th row and the n-th column. During the holding period following the writing period, the potential Vpix(m, n) of the pixel electrode Pix of the pixel PX in the m-th row and the n-th column is held at the GND potential by the first holding capacitance C1 and the second holding capacitance C2.

As illustrated in FIG. 4C, when the source bus line (signal line) DTL(n) is supplied with a negative source potential VSL that is a higher potential than the negative gate potential VGL, that is, when the source drive signal (pixel signal) SIG(n) is set to the negative source potential VSL, supplying the negative gate potential VGL to the gate bus line (scan line) SCL(m) during the writing period of the pixels PX in the m-th row controls to turn on the pixel transistor TR of the pixel PX in the m-th row (refer to FIG. 3), and the negative source potential VSL is applied as the potential Vpix(m, n)

of the pixel electrode Pix of the pixel PX in the m-th row and the n-th column. During the holding period following the writing period, the potential Vpix(m, n) of the pixel electrode Pix of the pixel PX in the m-th row and the n-th column is held at the negative source potential VSL by the first holding capacitance C1 and the second holding capacitance C2.

In the EPD, the source drive signal applied to the source of the pixel transistor generally has a high voltage. Specifically, in the pixel configuration illustrated in FIG. 3, the positive source potential VSH is set to +28 V, for example, and the negative source potential VSL is set to −28 V, for example. In order to control to turn on the pixel transistor TR (refer to FIG. 3) during the writing period, the positive gate potential VGH is set to, for example, +38 V that is a higher potential than the positive source potential VSH, and the negative gate potential VGL is set to, for example, −38 V that is a lower potential than the negative source potential VSL. This configuration may lead to an increase in size of the source driver 21 and the gate driver 22. In addition, to increase the withstand voltage, securement of reliability of the TFT substrate 100 becomes an issue.

First Embodiment

Figure 5:
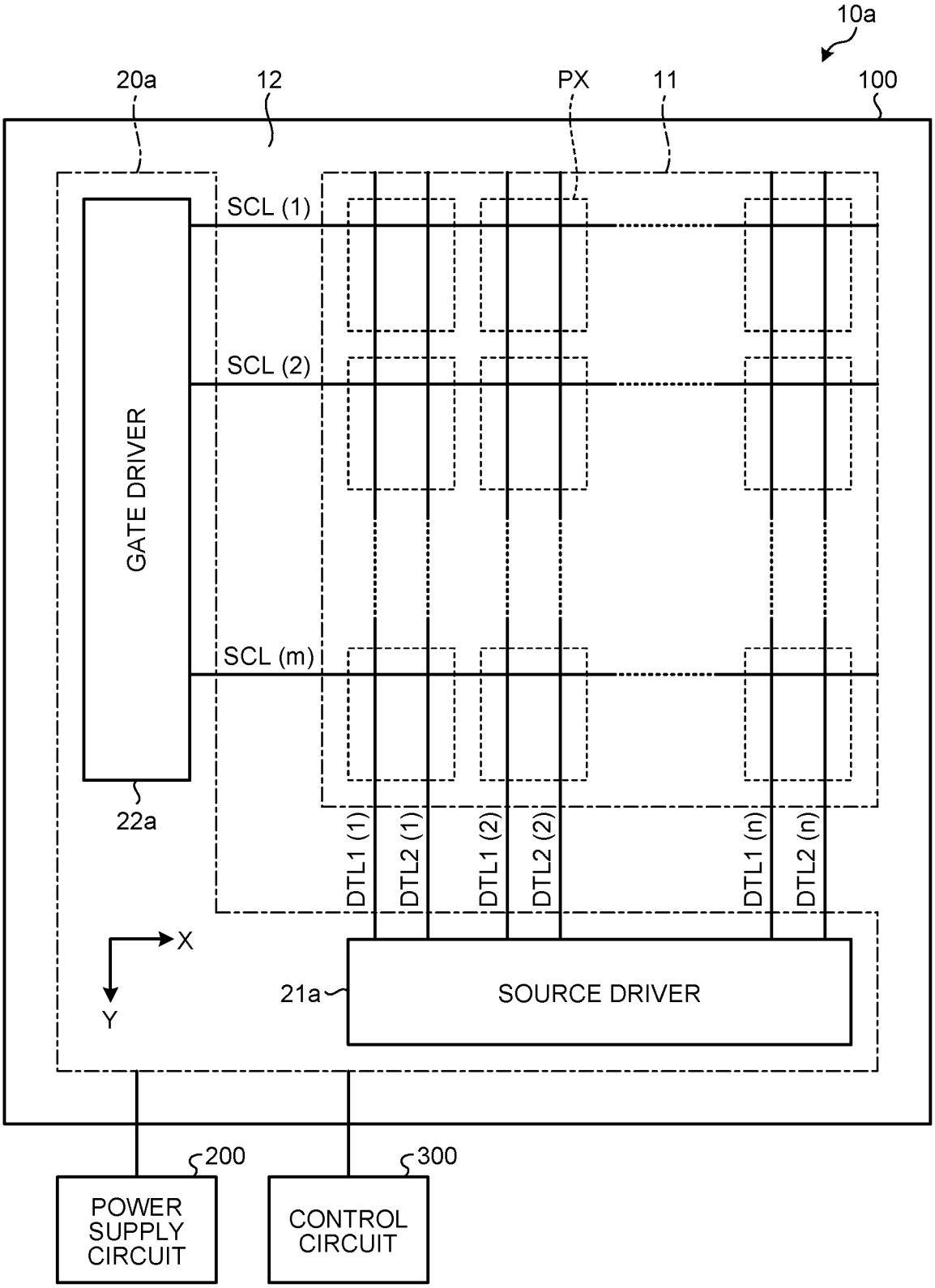
FIG. 5 is a block diagram illustrating a configuration example of a display device according to a first embodiment.
Figure 6:
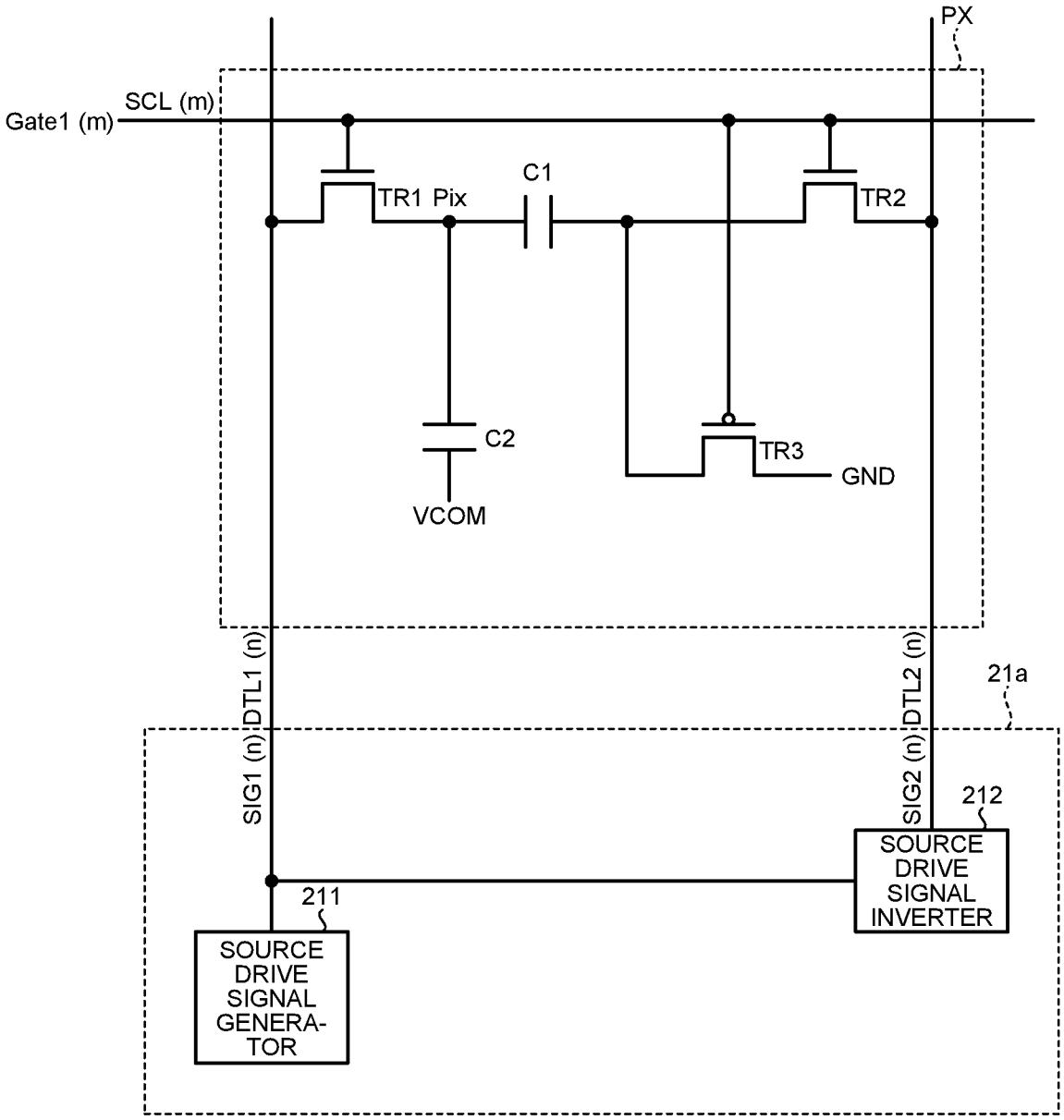
FIG. 6 is a diagram illustrating an exemplary configuration of one pixel and an exemplary internal configuration of a source driver in the display device according to the first embodiment.

FIG. 5 is a block diagram illustrating a configuration example of a display device according to a first embodiment. FIG. 6 is a diagram illustrating an exemplary configuration of one pixel and an exemplary internal configuration of a source driver in the display device according to the first embodiment.

As illustrated in FIG. 6, in a display device 10*a* according to the first embodiment, a source driver 21*a* of a display panel driver 20*a* includes a source drive signal generator 211 and a source drive signal inverter 212. The source drive signal generator 211 and the source drive signal inverter 212 are provided for each of the pixel rows. The source drive signal generator 211 is mounted on the display IC, for example. The source drive signal inverter 212 is, for example, a thin-film transistor (TFT) circuit formed in the frame region 12 on the TFT substrate 100.

In accordance with the video signal supplied from the control circuit 300, the source drive signal generator 211 generates a first source drive signal (first pixel signal) SIG1(n) that can take three values of the positive source potential VSH, the GND potential, and the negative source potential VSL to be supplied to a first source bus line (first signal line) DTL1(n). In the present embodiment, the positive source potential VSH is set to +15 V, for example. In the present embodiment, the negative source potential VSL is set to −15 V, for example.

The source drive signal inverter 212 supplies, to a second source bus line (second signal line) DTL2(n), a second source drive signal (second pixel signal) SIG2(n) obtained by inverting the signs of the positive source potential VSH and the negative source potential VSL of the first source drive signal (first pixel signal) SIG1(n) output from the source drive signal generator 211. The following describes operations of the source drive signal inverter 212 with reference to FIGS. 7, 8A, 8B, and 8C.

Figure 7:
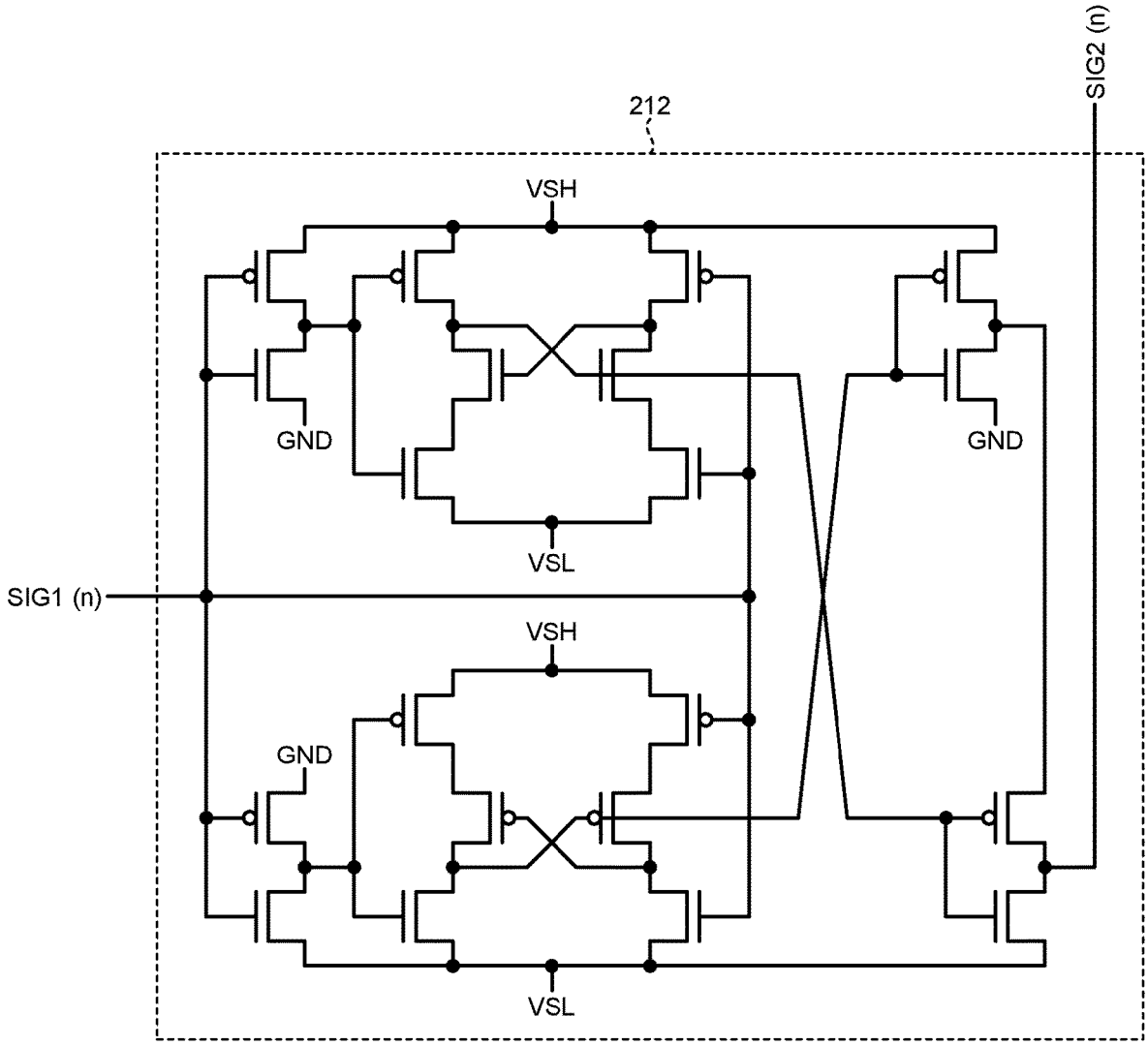
FIG. 7 is a block diagram illustrating an exemplary circuit configuration of a source drive signal inverter.
Figure 8A:
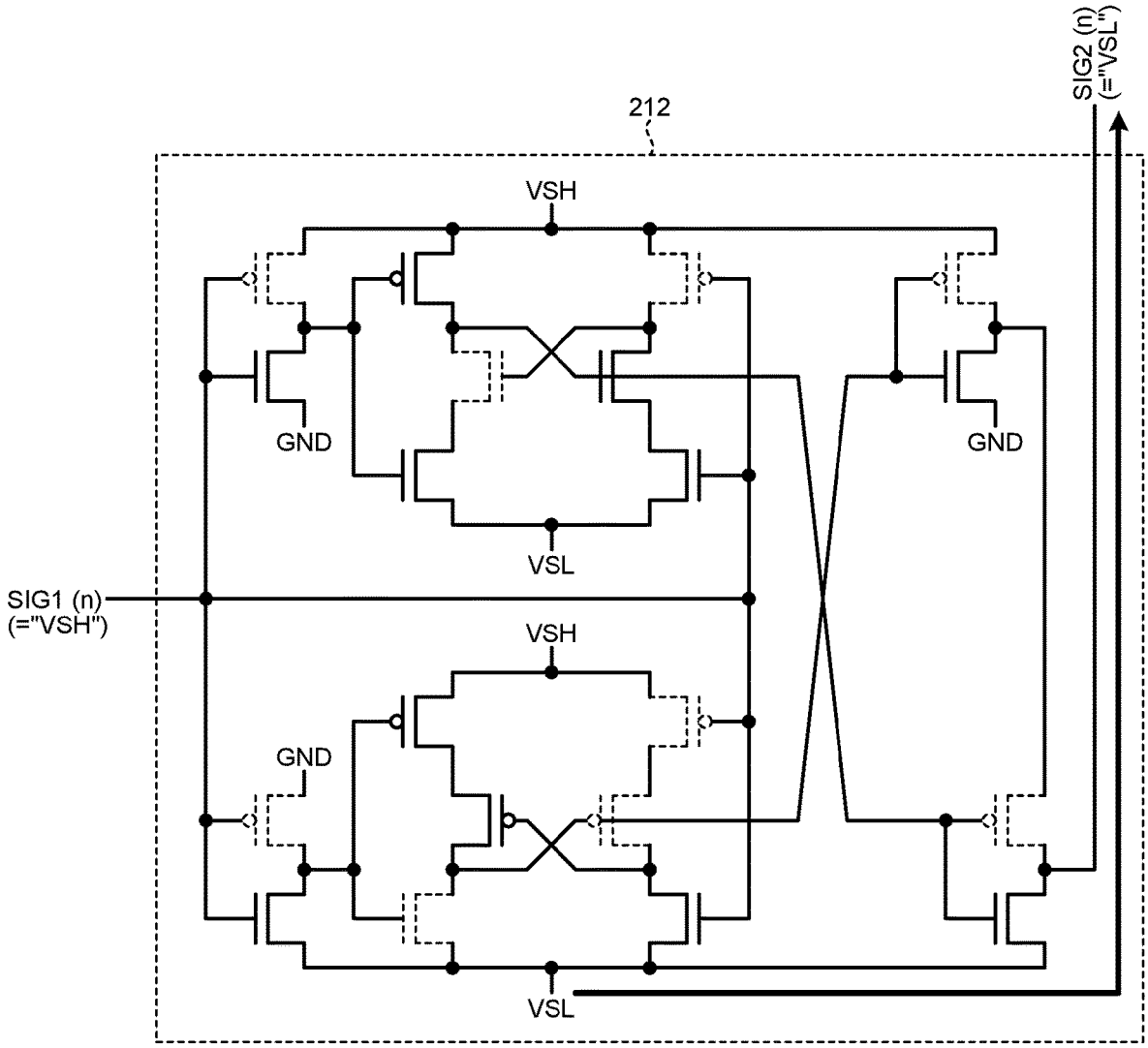
FIG. 8A is a conceptual diagram illustrating a specific example of an operation of the source drive signal inverter.
Figure 8B:
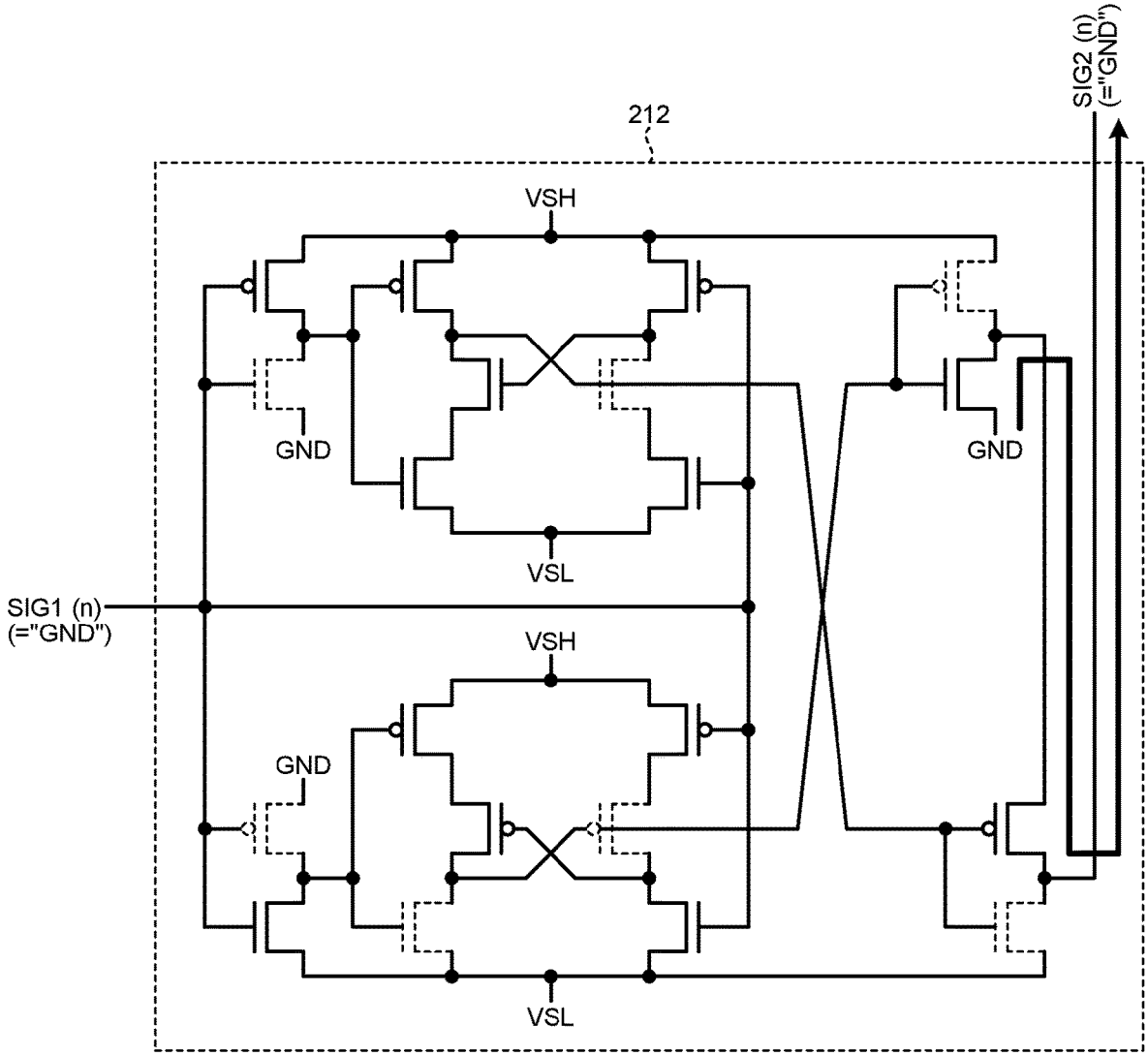
FIG. 8B is a conceptual diagram illustrating a specific example of another operation of the source drive signal inverter.
Figure 8C:
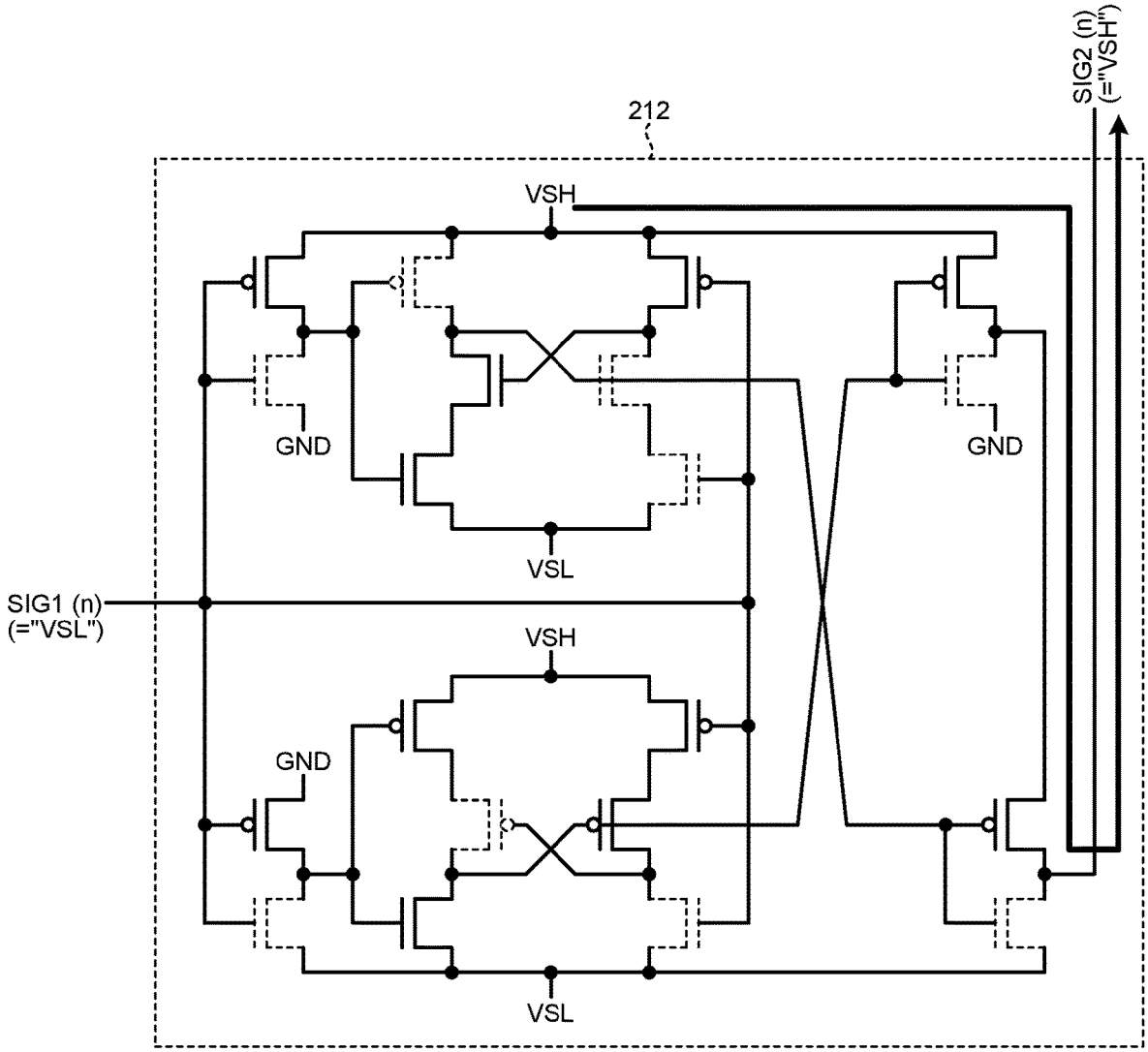
FIG. 8C is a conceptual diagram illustrating a specific example of still another operation of the source drive signal inverter.

FIG. 7 is a block diagram illustrating an exemplary circuit configuration of the source drive signal inverter. FIGS. 8A, 8B, and 8C are conceptual diagrams illustrating specific examples of the operations of the source drive signal inverter.

When the first source drive signal (first pixel signal) SIG1(n) is set to the positive source potential VSH, the source drive signal inverter 212 controls to turn off each of the transistors illustrated with dashed lines and outputs the negative source potential VSL through a path indicated by a solid arrow, as illustrated in FIG. 8A.

When the first source drive signal (first pixel signal) SIG1(n) is set to the GND potential, the source drive signal inverter 212 controls to turn off each of the transistors illustrated with dashed lines and outputs the GND potential through a path indicated by a solid arrow, as illustrated in FIG. 8B.

When the first source drive signal (first pixel signal) SIG1(n) is set to the negative source potential VSL, the source drive signal inverter 212 controls to turn off each of the transistors illustrated with dashed lines and outputs the positive source potential VSH through a path indicated by a solid arrow, as illustrated in FIG. 8C.

The configurations and the operations of the source drive signal inverter 212 illustrated in FIGS. 7, 8A, 8B, and 8C are merely examples and are not limited to the examples illustrated in FIGS. 7, 8A, 8B, and 8C.

As illustrated in FIG. 6, the pixel PX according to the first embodiment includes a first pixel transistor TR1, a second pixel transistor TR2, and a third pixel transistor TR3.

In the present embodiment, the first pixel transistor TR1 is an NMOS transistor corresponding to the pixel transistor TR in the comparative example described above. In the present embodiment, the first holding capacitance C1 is coupled to the second source bus line (second signal line) DTL2(n) through the second pixel transistor TR2 serving as an NMOS transistor. That is, in the present embodiment, the holding electrode Base illustrated in FIG. 1 is electrically coupled to the second source bus line (second signal line) DTL2(n) through the second pixel transistor TR2. The first holding capacitance C1 is coupled to the GND potential through the third pixel transistor TR3 serving as a p-channel metal oxide semiconductor (PMOS) transistor. That is, in the present embodiment, the holding electrode Base illustrated in FIG. 1 is coupled to the GND potential through the third pixel transistor TR3.

The gate bus line (scan line) SCL(m) is coupled to the gates of the second and the third pixel transistors TR2 and TR3. With this configuration, when the gate drive signal (scan signal) Gate(m) supplied to the gate bus line (scan line) SCL(m) is set to the positive gate potential VGH, the first holding capacitance C1 is coupled to the second source bus line (second signal line) DTL2(n) through the second pixel transistor TR2. When the gate drive signal (scan signal) Gate(m) supplied to the gate bus line (scan line) SCL(m) is set to the negative gate potential VGL, the first holding capacitance C1 is coupled to the GND potential through the third pixel transistor TR3.

Figure 9A:
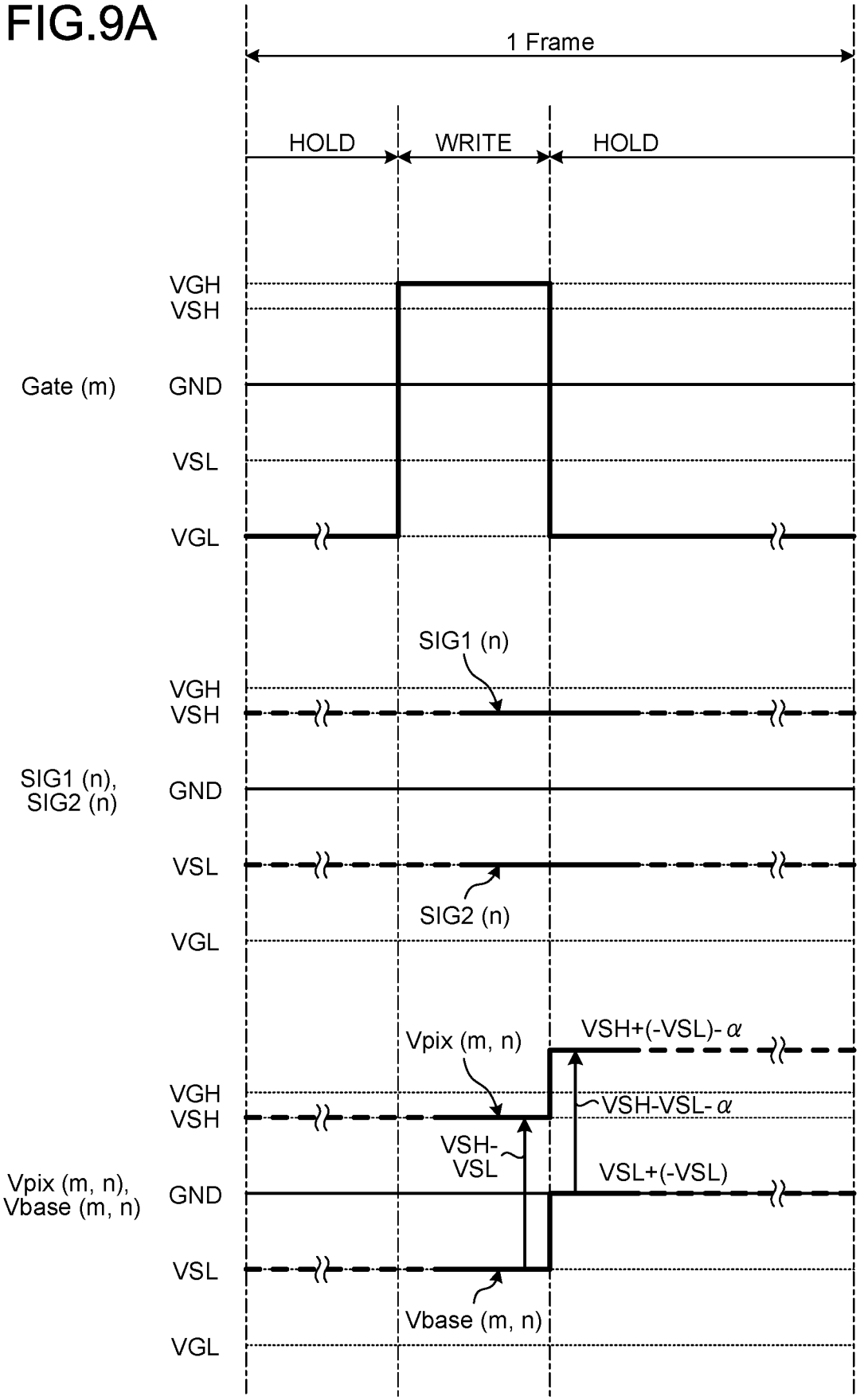
FIG. 9A is a timing diagram for explaining an operation in the first embodiment.
Figure 9B:
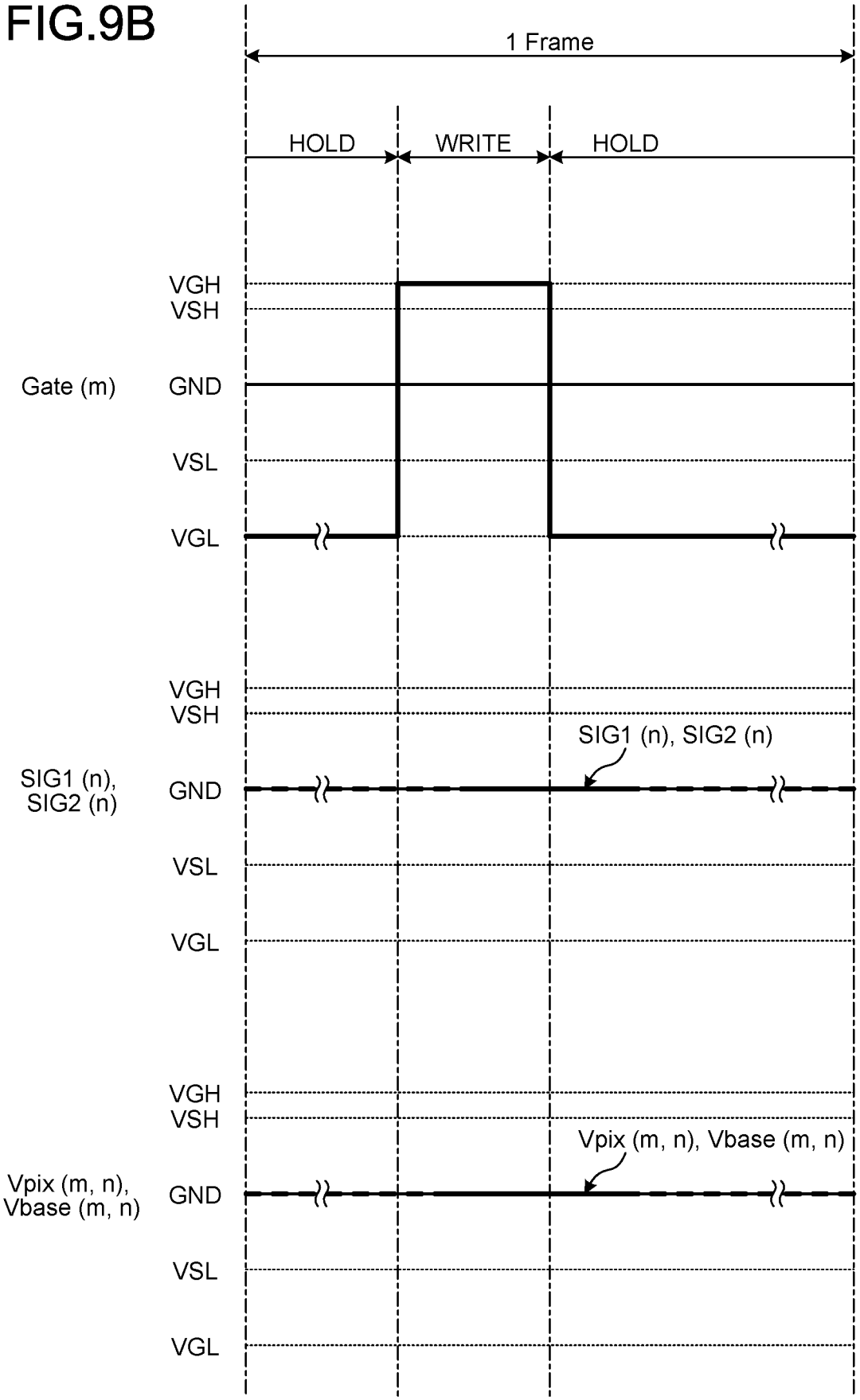
FIG. 9B is a timing diagram for explaining another operation in the first embodiment.
Figure 9C:
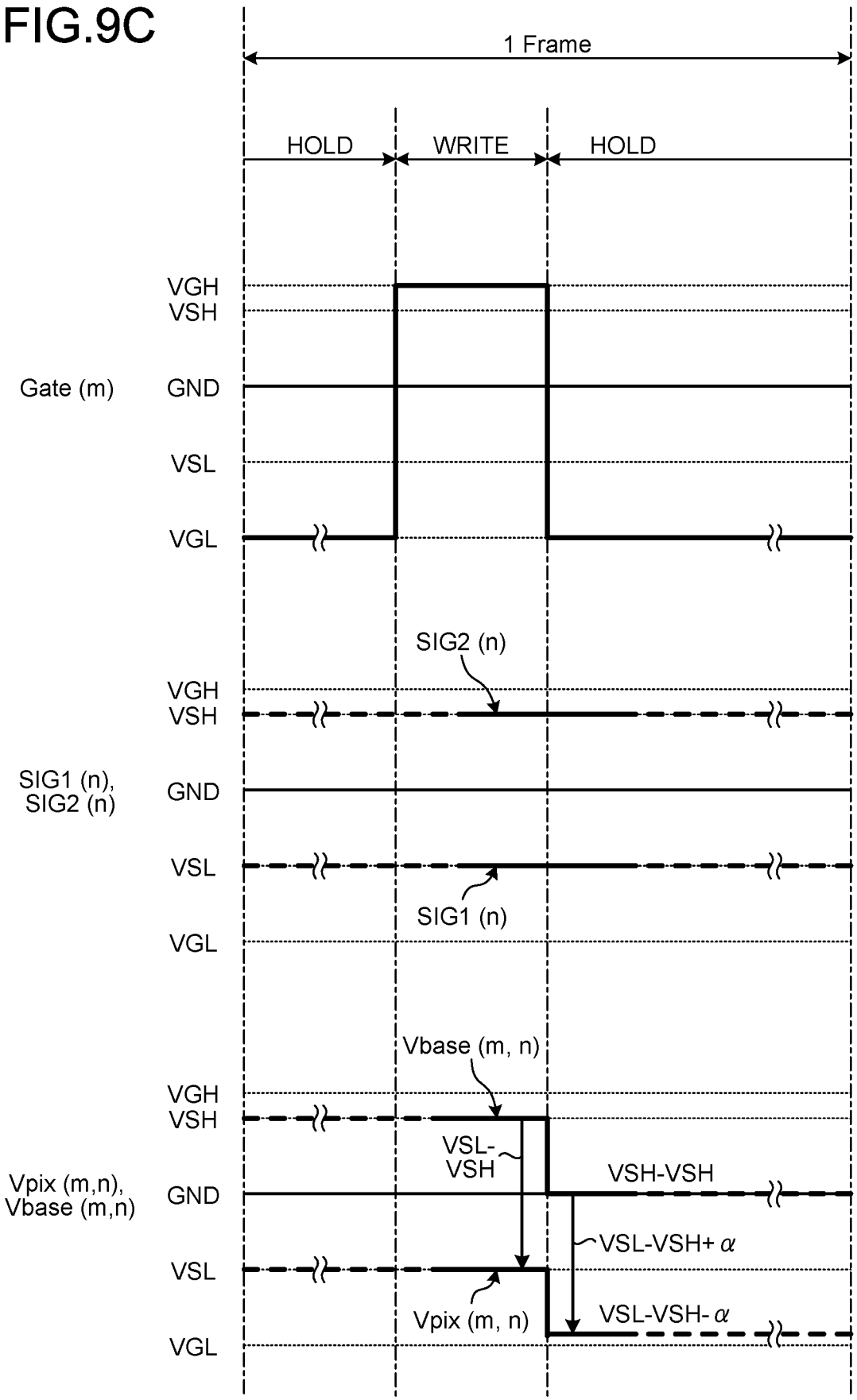
FIG. 9C is a timing diagram for explaining still another operation in the first embodiment.

FIGS. 9A, 9B, and 9C are timing diagrams for explaining operations in the first embodiment.

As illustrated in FIGS. 9A, 9B, and 9C, a gate driver 22*a* supplies the positive gate potential VGH to the gate bus line (scan line) SCL(m) during the writing period of each of the pixels PX in the m-th row. The gate driver 22*a* supplies the negative gate potential VGL to the gate bus line (scan line) SCL(m) during the holding period other than the writing period. In the present embodiment, the positive gate potential VGH is set to +20 V, for example. In the present embodiment, the negative gate potential VGL is set to −34 V, for example.

As illustrated in FIG. 9A, when the first source bus line (first signal line) DTL1(n) is supplied with the positive source potential VSH (at +15 V, for example), that is, when the first source drive signal (first pixel signal) SIG1(n) is set to the positive source potential VSH, the second source bus line (second signal line) DTL2(n) is supplied with the negative source potential VSL (at −15 V, for example). That is, the second source drive signal (second pixel signal) SIG2(n) is set to the negative source potential VSL.

When the gate bus line (scan line) SCL(m) is supplied with the positive gate potential VGH (at +20 V, for example) during the writing period, the first and the second pixel transistors TR1 and TR2 are controlled to be turned on, and the third pixel transistor TR3 is controlled to be turned off. As a result, the positive source potential VSH is applied as the potential Vpix(m, n) onto the pixel electrode Pix side of the first holding capacitance C1, and the negative source potential VSL is applied as a potential Vbase(m, n) onto the other side different from the pixel electrode Pix side of the first holding capacitance C1. As a result, the first holding capacitance C1 is charged by a difference VSH−VSL between the positive source potential VSH and the negative source potential VSL (at +15 V−(−15 V)=30 V, for example).

When the gate bus line (scan line) SCL(m) is supplied with the negative gate potential VGL (at −34 V, for example) during the holding period following the writing period, the first and the second pixel transistors TR1 and TR2 are controlled to be turned off, and the third pixel transistor TR3 is controlled to be turned on. This operation applies the GND potential as the potential Vbase(m, n) onto the other side different from the pixel electrode Pix side of the first holding capacitance C1. As a result, the potential Vpix(m, n) of the pixel electrode Pix is increased to VSH+(−VSL)−α (for example, +15 V+(−(−15 V))−α=30 V−α) by voltage dividing between the first holding capacitance C1 and the second holding capacitance C2. Thus, the potential Vpix(m, n) of the pixel electrode Pix is held at VSH+(−VSL)−α (for example, +15 V+(−(−15 V))−α=30 V−α) during the holding period. α is represented by Expression (1) below.

$$\alpha=-VSL\times C2/(C2+C1) \quad (1)$$

As described above, the first holding capacitance C1 is approximately 1 pF, for example. The second holding capacitance C2 is, for example, approximately 1/10 of the first holding capacitance C1. In this case, assuming that the positive source potential VSH is +15 V and the negative source potential VSL is −15 V, α≈1.36 V. In this case, the potential Vpix(m, n) of the pixel electrode Pix is held at 28.64 V during the holding period.

As illustrated in FIG. 9B, when the first source bus line (first signal line) DTL1(n) is supplied with the GND potential (at 0 V), that is, when the first source drive signal (first pixel signal) SIG1(n) is set to the GND potential, the second source bus line (second signal line) DTL2(n) is supplied with the GND potential (at 0 V). That is, the second source drive signal (second pixel signal) SIG2(n) is set to the GND potential.

When the gate bus line (scan line) SCL(m) is supplied with the positive gate potential VGH (at +20 V, for example) during the writing period, the first and the second pixel transistors TR1 and TR2 are controlled to be turned on, and the third pixel transistor TR3 is controlled to be turned off. As a result, the GND potential is applied as the potential Vpix(m, n) onto the pixel electrode Pix side of the first holding capacitance C1, and the GND potential is applied as the potential Vbase(m, n) onto the other side different from the pixel electrode Pix side of the first holding capacitance C1. As a result, the voltage between both ends of the first holding capacitance C1 is set to 0 V.

When the gate bus line (scan line) SCL(m) is supplied with the negative gate potential VGL (at −34 V, for example) during the holding period following the writing period, the first and the second pixel transistors TR1 and TR2 are controlled to be turned off, and the third pixel transistor TR3 is controlled to be turned on. This operation applies the GND potential as the potential Vbase(m, n) onto the other side different from the pixel electrode Pix side of the first holding capacitance C1. Thus, the potential Vpix(m, n) of the pixel electrode Pix is held at 0 V, that is, at the GND potential during the holding period.

As illustrated in FIG. 9C, when the first source bus line (first signal line) DTL1(n) is supplied with the negative source potential VSL (at −15 V, for example), that is, when the first source drive signal (first pixel signal) SIG1(n) is set to the negative source potential VSL, the second source bus line (second signal line) DTL2(n) is supplied with the positive source potential VSH (at +15 V, for example). That is, the second source drive signal (second pixel signal) SIG2(n) is set to the positive source potential VSH.

When the gate bus line (scan line) SCL(m) is supplied with the positive gate potential VGH (at +20 V, for example) during the writing period, the first and the second pixel transistors TR1 and TR2 are controlled to be turned on, and the third pixel transistor TR3 is controlled to be turned off. As a result, the negative source potential VSL is applied as the potential Vpix(m, n) onto the pixel electrode Pix side of the first holding capacitance C1, and the positive source potential VSH is applied as the potential Vbase(m, n) onto the other side different from the pixel electrode Pix side of the first holding capacitance C1. As a result, the first holding capacitance C1 is charged by a difference VSL−VSH between the negative source potential VSL and the positive source potential VSH (at −15 V−15 V=−30 V, for example).

When the gate bus line (scan line) SCL(m) is supplied with the negative gate potential VGL (at −34 V, for example) during the holding period following the writing period, the first and the second pixel transistors TR1 and TR2 are controlled to be turned off, and the third pixel transistor TR3 is controlled to be turned on. This operation applies the GND potential as the potential Vbase(m, n) onto the other side different from the pixel electrode Pix side of the first holding capacitance C1. As a result, the potential Vpix(m, n) of the pixel electrode Pix is increased to VSL−VSH+α (for example, −15 V−15 V+α=−30 V+α) by the voltage dividing between the first holding capacitance C1 and the second holding capacitance C2. Thus, the potential Vpix(m, n) of the pixel electrode Pix is held at VSL−VSH+α (for example, −15 V−15 V+α=−30 V+α) during the holding period. α is represented by Expression (2) below.

$$\alpha=VSH\times C2/(C2+C1) \quad (2)$$

As described above, the first holding capacitance C1 is approximately 1 pF, for example. The second holding capacitance C2 is, for example, approximately 1/10 of the first holding capacitance C1. In this case, assuming that the positive source potential VSH is +15 V and the negative source potential VSL is −15 V, α≈1.36 V. In this case, the potential Vpix(m, n) of the pixel electrode Pix is held at −28.64 V during the holding period.

Thus, the configuration of the first embodiment enables driving at a lower voltage than the configuration of the comparative example (FIGS. 2 and 3) does while keeping the potential Vpix(m, n) of the pixel electrode Pix at the same value as that of the comparative example described above. As a result, the display IC and the TFT substrate 100 can have a lower withstand voltage and thus can contribute to reduction in cost and improvement in reliability.

Second Embodiment

Figure 10:
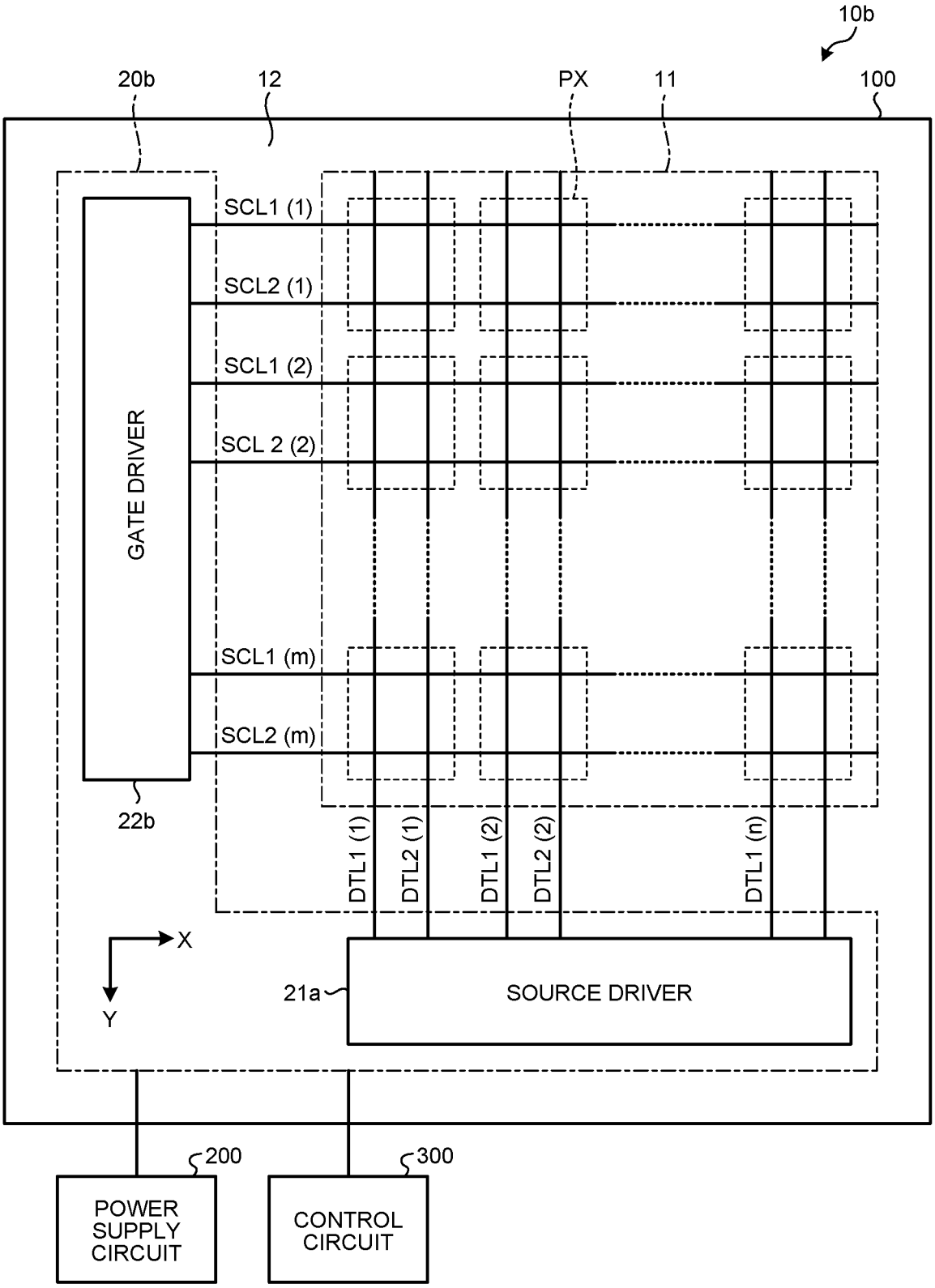
FIG. 10 is a block diagram illustrating a configuration example of a display device according to a second embodiment.
Figure 11:
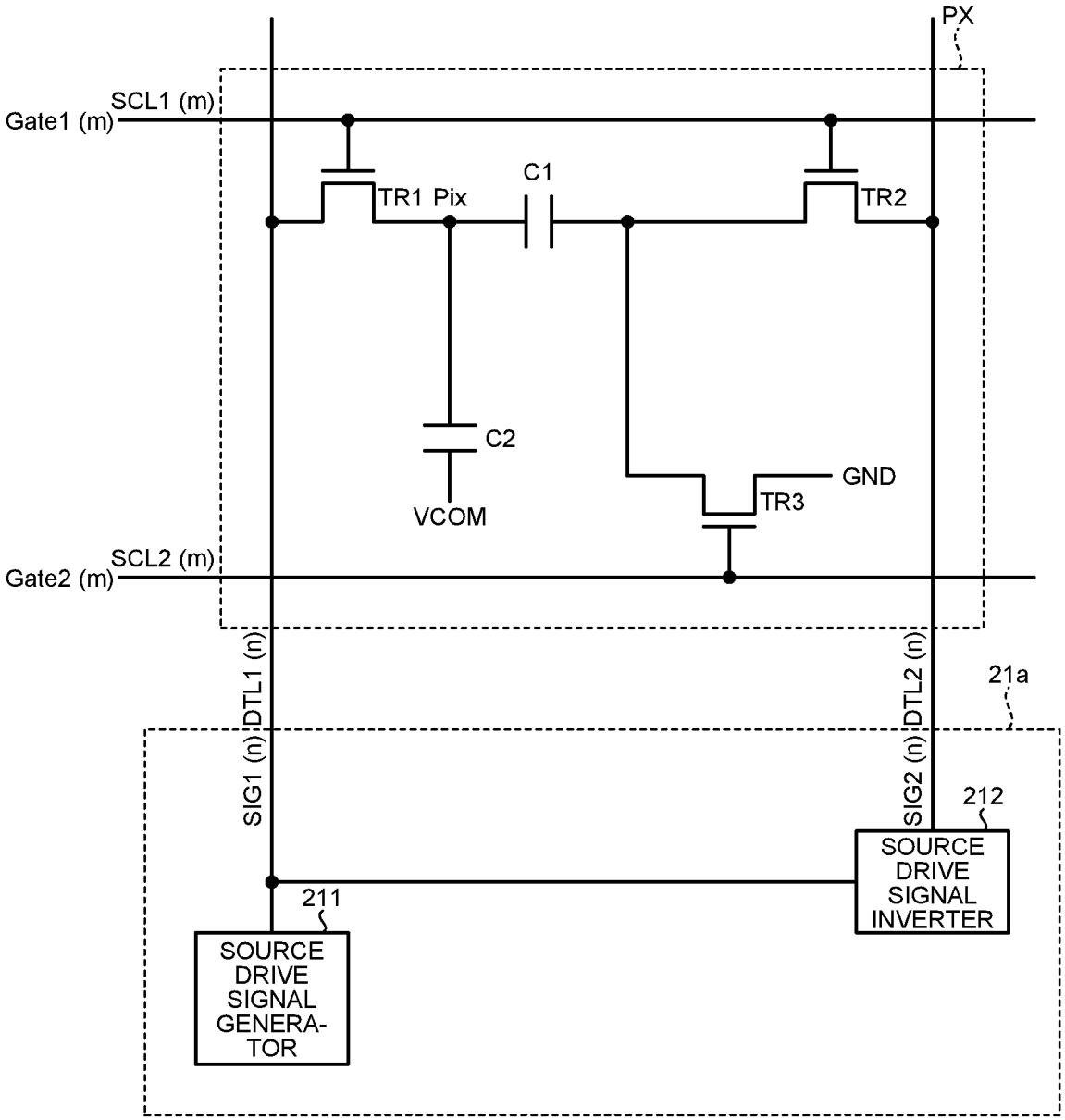
FIG. 11 is a diagram illustrating an exemplary configuration of one pixel and an exemplary internal configuration of the source driver in the display device according to the second embodiment.
Figure 12A:
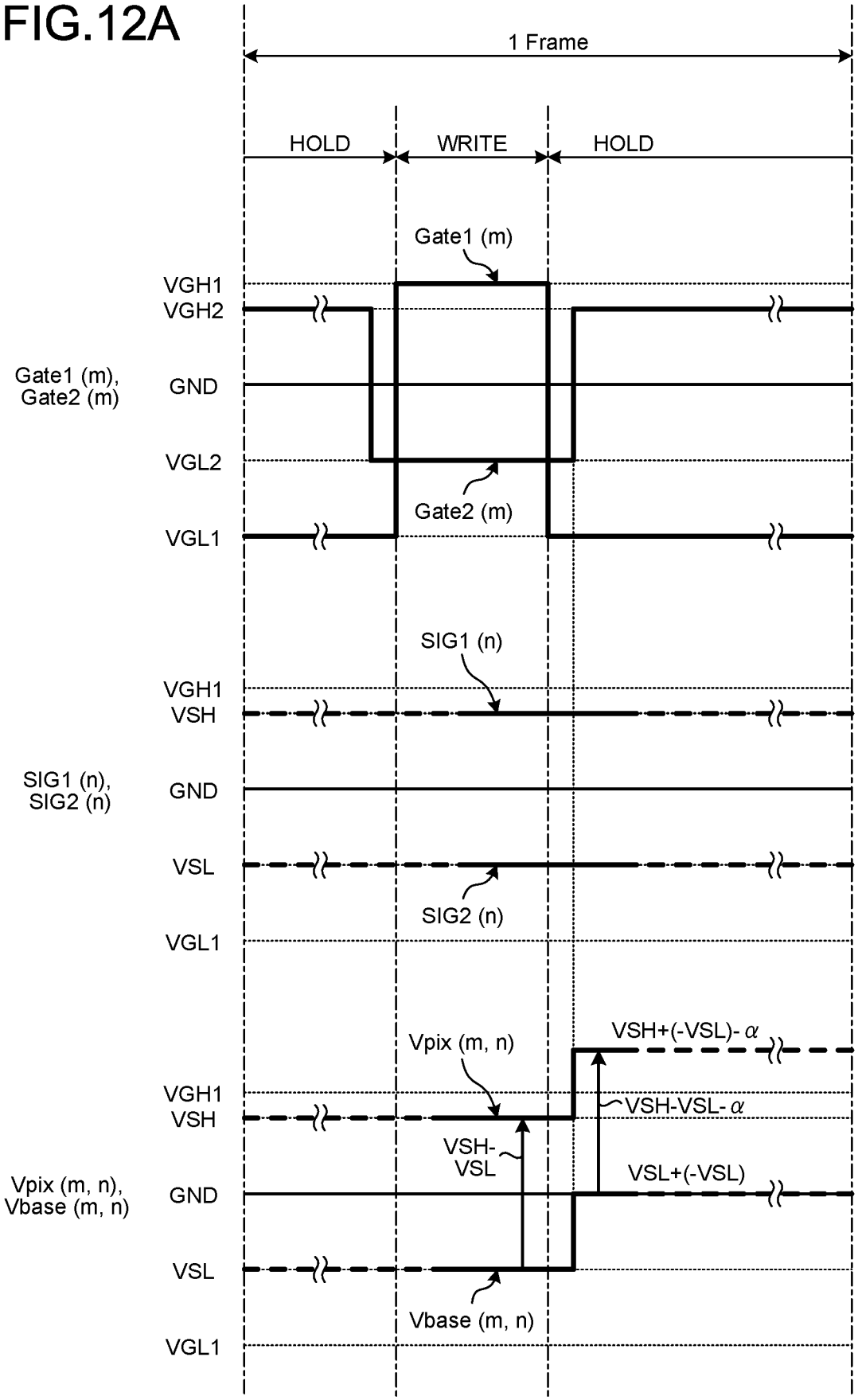
FIG. 12A is a timing diagram for explaining an operation in the second embodiment.
Figure 12B:
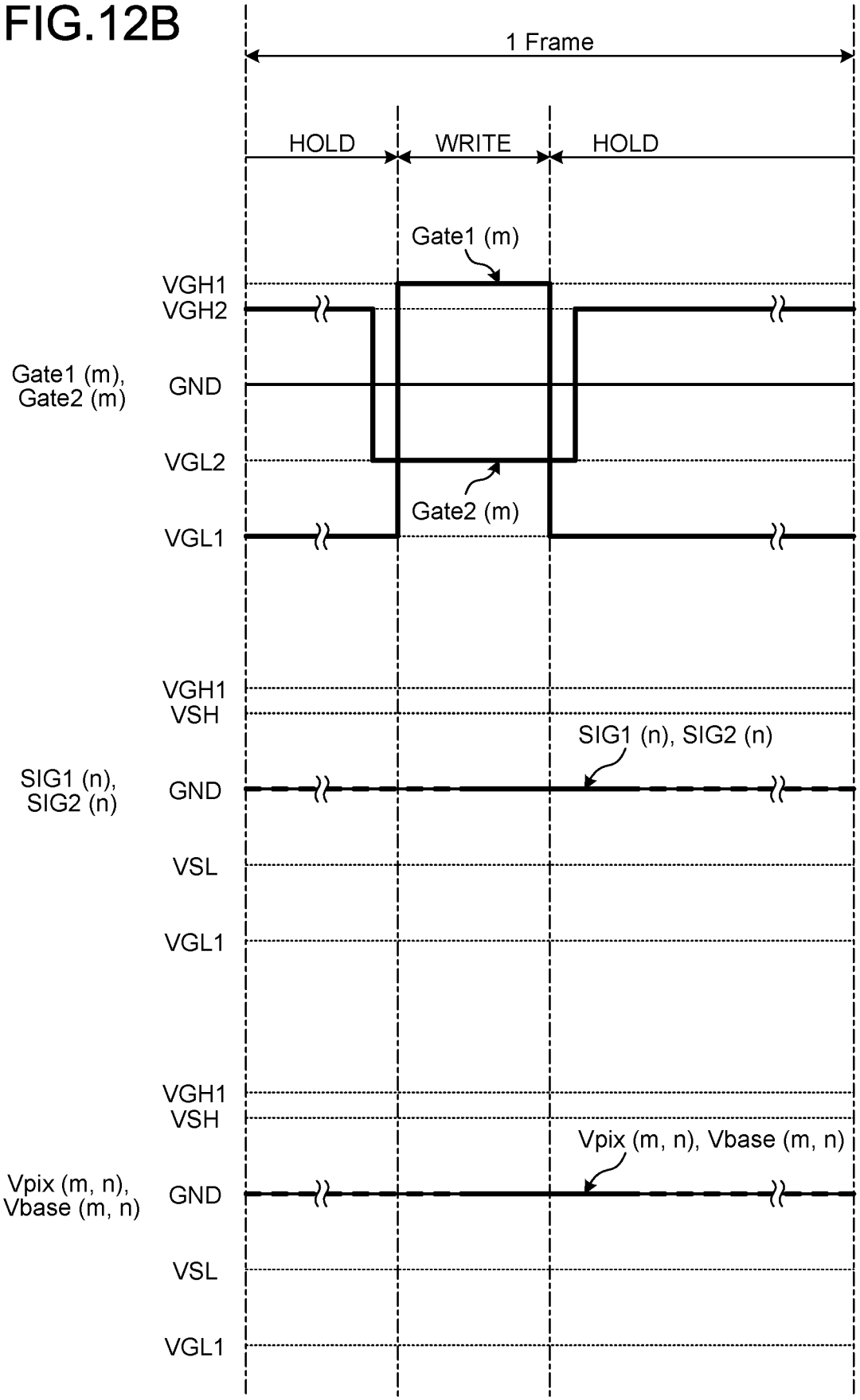
FIG. 12B is a timing diagram for explaining another operation in the second embodiment.
Figure 12C:
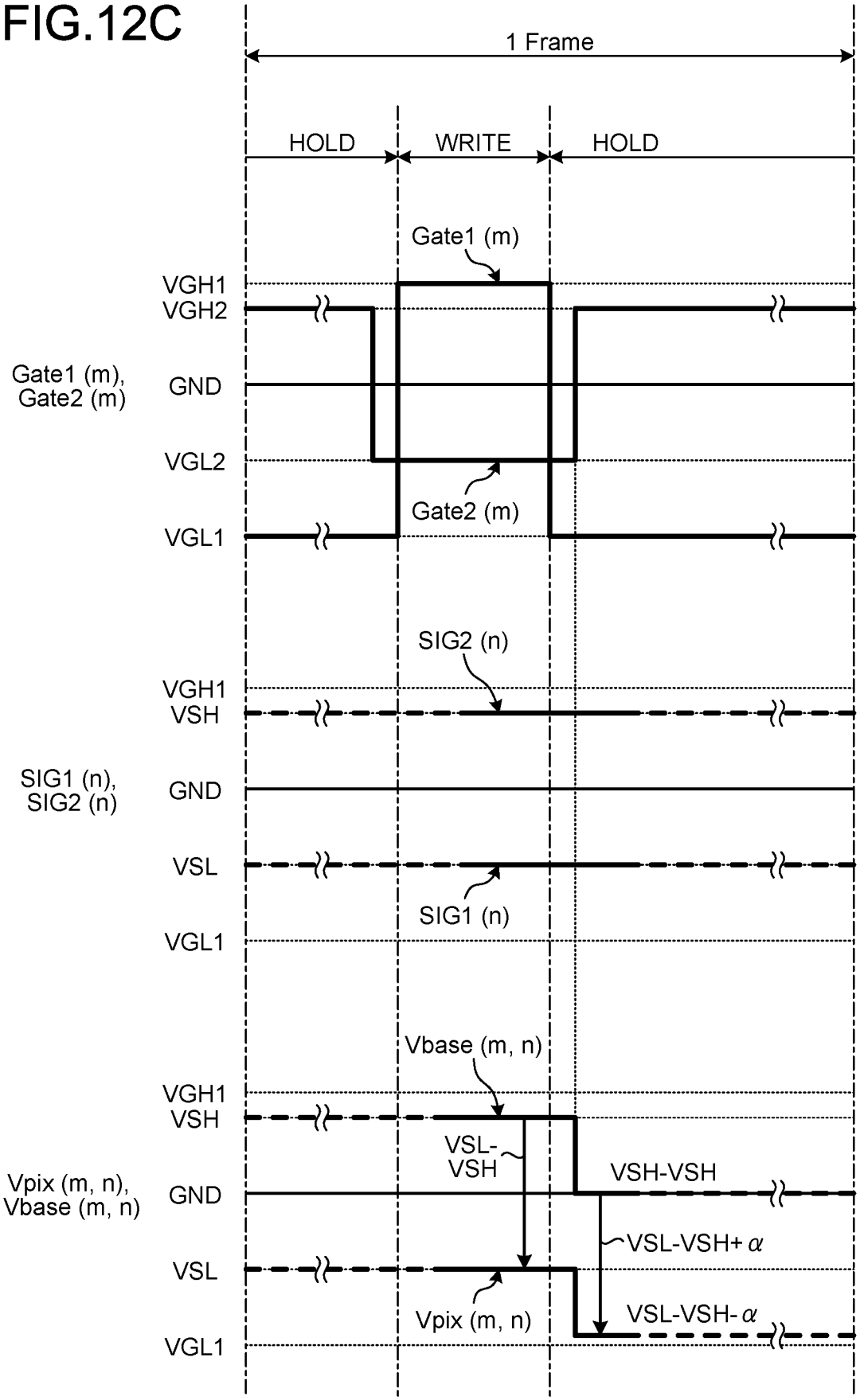
FIG. 12C is a timing diagram for explaining still another operation in the second embodiment.

FIG. 10 is a block diagram illustrating a configuration example of a display device according to a second embodiment. FIG. 11 is a diagram illustrating an exemplary configuration of one pixel and an exemplary internal configuration of the source driver in the display device according to the second embodiment. FIGS. 12A, 12B, and 12C are timing diagrams for explaining operations in the second embodiment. In the following description, the same components as those described in the first embodiment above will be denoted by the same reference numerals, the repetitive explanation thereof will be omitted, and only differences from the first embodiment will be described.

In a display device 10*b* according to the second embodiment, a gate driver 22*b* of a display panel driver 20*b* is electrically coupled to the pixels PX arranged in the X-direction in the display region 11 through a first gate bus line (first scan line) SCL1(m) and transmits a first gate drive signal (first scan signal) Gate1(m) to the first gate bus line (first scan line) SCL1(m). The gate driver 22*b* supplies a first positive gate potential VGH1 to the first gate bus line (first scan line) SCL1(m) during the writing period. The gate driver 22*b* supplies a first negative gate potential VGL1 to the first gate bus line (first scan line) SCL1(m) during the holding period. In the present embodiment, the first positive gate potential VGH1 is set to +20 V, for example. In the present embodiment, the first negative gate potential VGL1 is set to −34 V, for example.

The gate driver 22*b* is also electrically coupled to the pixels PX arranged in the X-direction in the display region 11 through a second gate bus line (second scan line) SCL2(m) and transmits a second gate drive signal (second scan signal) Gate2(m) to the second gate bus line (second scan line) SCL2(m). The gate driver 22*b* supplies a second negative gate potential VGL2 to the second gate bus line (second scan line) SCL2(m) during the writing period. The gate driver 22*b* supplies a second positive gate potential VGH2 to the second gate bus line (second scan line) SCL2(m) during the holding period. In the present embodiment, the second negative gate potential VGL2 is set to −15 V, for example. In the present embodiment, the second positive gate potential VGH2 is set to +15 V, for example.

As illustrated in FIG. 11, in the pixel PX according to the second embodiment, the second gate bus line (second scan line) SCL2(m) is coupled to the gate of the third pixel transistor TR3 serving as an NMOS transistor. With this configuration, when the second gate drive signal (second scan signal) Gate2(m) supplied to the second gate bus line (second scan line) SCL2(m) is set to the second positive gate potential VGH2, the first holding capacitance C1 is coupled to the GND potential through the third pixel transistor TR3.

As illustrated in FIG. 12A, when the first source bus line (first signal line) DTL1(n) is supplied with the positive source potential VSH (at +15 V, for example), that is, when the first source drive signal (first pixel signal) SIG1(n) is set to the positive source potential VSH, the second source bus line (second signal line) DTL2(n) is supplied with the negative source potential VSL (at −15 V, for example). That is, the second source drive signal (second pixel signal) SIG2(n) is set to the negative source potential VSL.

When the first gate bus line (first scan line) SCL1(m) is supplied with the first negative gate potential VGL1 (at −34 V, for example) during the holding period, the first and the second pixel transistors TR1 and TR2 are controlled to be turned off. When the second gate bus line (second scan line) SCL2(m) is supplied with the second negative gate potential VGL2 (at −15 V, for example) before the writing period, the third pixel transistor TR3 is controlled to be turned off. As a result, the first, the second, and the third pixel transistors TR1, TR2, and TR3 are placed in an off state. When the first gate bus line (first scan line) SCL1(m) is supplied with the first positive gate potential VGH1 (at +20 V, for example) in the writing period, the first and the second pixel transistors TR1 and TR2 are controlled to be turned on. As a result, the positive source potential VSH is applied as the potential Vpix(m, n) onto the pixel electrode Pix side of the first holding capacitance C1, and the negative source potential VSL is applied as the potential Vbase(m, n) onto the other side different from the pixel electrode Pix side of the first holding capacitance C1. As a result, the first holding capacitance C1 is charged by the difference VSH−VSL between the positive source potential VSH and the negative source potential VSL (at +15 V−(−15 V)=30 V, for example).

When the first gate bus line (first scan line) SCL1(m) is supplied with the first negative gate potential VGL1 (at −34 V, for example) in the holding period following the writing period, the first and the second pixel transistors TR1 and TR2 are controlled to be turned off. As a result, the first, the second, and the third pixel transistors TR1, TR2, and TR3 are placed in the off state. When the second gate bus line (second scan line) SCL2(m) is supplied with the second positive gate potential VGH2 (at +15 V, for example) after the holding period has started, the third pixel transistor TR3 is controlled to be turned on. This operation applies the GND potential as the potential Vbase(m, n) onto the other side different from the pixel electrode Pix side of the first holding capacitance C1. As a result, the potential Vpix(m, n) of the pixel electrode Pix is increased to VSH+(−VSL)−α (for example, +15 V+(−(−15 V))−α=30 V−α) by voltage dividing between the first holding capacitance C1 and the second holding capacitance C2. Thus, the potential Vpix(m, n) of the pixel electrode Pix is held at VSH+(−VSL)−α (for example, +15 V+(−(−15 V))−α=30 V−α) during the holding period.

As illustrated in FIG. 12B, when the first source bus line (first signal line) DTL1(n) is supplied with the GND potential (at 0 V), that is, when the first source drive signal (first pixel signal) SIG1(n) is set to the GND potential, the second source bus line (second signal line) DTL2(n) is supplied with the GND potential (at 0 V). That is, the second source drive signal (second pixel signal) SIG2(n) is set to the GND potential.

When the first gate bus line (first scan line) SCL1(m) is supplied with the first negative gate potential VGL1 (at −34 V, for example) during the holding period, the first and the second pixel transistors TR1 and TR2 are controlled to be turned off. When the second gate bus line (second scan line) SCL2(m) is supplied with the second negative gate potential VGL2 (at −15 V, for example) before the writing period, the third pixel transistor TR3 is controlled to be turned off. As a result, the first, the second, and the third pixel transistors TR1, TR2, and TR3 are placed in the off state. When the first gate bus line (first scan line) SCL1(m) is supplied with the first positive gate potential VGH1 (at +20 V, for example) in the writing period, the first and the second pixel transistors TR1 and TR2 are controlled to be turned on. This operation applies the GND potential as the potential Vbase(m, n) onto the other side different from the pixel electrode Pix side of the first holding capacitance C1. As a result, the GND potential is applied as the potential Vpix(m, n) onto the pixel electrode Pix side of the first holding capacitance C1, and the GND potential is applied as the potential Vbase(m, n) onto the other side different from the pixel electrode Pix side of the first holding capacitance C1. As a result, the voltage between both ends of the first holding capacitance C1 is set to 0 V.

When the first gate bus line (first scan line) SCL1(m) is supplied with the first negative gate potential VGL1 (at −34 V, for example) in the holding period following the writing period, the first and the second pixel transistors TR1 and TR2 are controlled to be turned off. As a result, the first, the second, and the third pixel transistors TR1, TR2, and TR3 are placed in the off state. When the second gate bus line (second scan line) SCL2(m) is supplied with the second positive gate potential VGH2 (at +15 V, for example) after the holding period has started, the third pixel transistor TR3 is controlled to be turned on. This operation applies the GND potential as the potential Vbase(m, n) onto the other side different from the pixel electrode Pix side of the first holding capacitance C1. Thus, the potential Vpix(m, n) of the pixel electrode Pix is held at 0 V, that is, at the GND potential during the holding period.

As illustrated in FIG. 12C, when the first source bus line (first signal line) DTL1(n) is supplied with the negative source potential VSL (at −15 V, for example), that is, when the first source drive signal (first pixel signal) SIG1(n) is set to the negative source potential VSL, the second source bus line (second signal line) DTL2(n) is supplied with the positive source potential VSH (at +15 V, for example). That is, the second source drive signal (second pixel signal) SIG2(n) is set to the positive source potential VSH.

When the first gate bus line (first scan line) SCL1(m) is supplied with the first negative gate potential VGL1 (at −34 V, for example) during the holding period, the first and the second pixel transistors TR1 and TR2 are controlled to be turned off. When the second gate bus line (second scan line) SCL2(m) is supplied with the second negative gate potential VGL2 (at −15 V, for example) before the writing period, the third pixel transistor TR3 is controlled to be turned off. As a result, the first, the second, and the third pixel transistors TR1, TR2, and TR3 are placed in the off state. When the first gate bus line (first scan line) SCL1(m) is supplied with the first positive gate potential VGH1 (at +20 V, for example) in the writing period, the first and the second pixel transistors TR1 and TR2 are controlled to be turned on. As a result, the negative source potential VSL is applied as the potential Vpix(m, n) onto the pixel electrode Pix side of the first holding capacitance C1, and the positive source potential VSH is applied as the potential Vbase(m, n) onto the other side different from the pixel electrode Pix side of the first holding capacitance C1. As a result, the first holding capacitance C1 is charged by the difference VSL−VSH between the negative source potential VSL and the positive source potential VSH (at −15 V−15 V=−30 V, for example).

When the first gate bus line (first scan line) SCL1(m) is supplied with the first negative gate potential VGL1 (at −34 V, for example) in the holding period following the writing period, the first and the second pixel transistors TR1 and TR2 are controlled to be turned off. As a result, the first, the second, and the third pixel transistors TR1, TR2, and TR3 are placed in the off state. When the second gate bus line (second scan line) SCL2(m) is supplied with the second positive gate potential VGH2 (at +15 V, for example) after the holding period has started, the third pixel transistor TR3 is controlled to be turned on. This operation applies the GND potential as the potential Vbase(m, n) onto the other side different from the pixel electrode Pix side of the first holding capacitance C1. As a result, the potential Vpix(m, n) of the pixel electrode Pix is increased to VSL−VSH+α (for example, −15 V−15 V+α=−30 V+α) by the voltage dividing between the first holding capacitance C1 and the second holding capacitance C2. Thus, the potential Vpix(m, n) of the pixel electrode Pix is held at VSL−VSH+α (for example, −15 V−15 V+α=−30 V+α) during the holding period.

Thus, with the configuration of the second embodiment, the second gate bus line (second scan line) SCL2(m) is supplied with the second negative gate potential VGL2 (at −15 V, for example) before the writing period, and the third pixel transistor TR3 is controlled to be turned off. As a result, the first, the second, and the third pixel transistors TR1, TR2, and TR3 are placed in the off state before the writing period, thus being capable of preventing the second pixel transistor TR2 and the third pixel transistor TR3 from being simultaneously placed in the on state.

After the holding period has started, the second gate bus line (second scan line) SCL2(m) is supplied with the second positive gate potential VGH2 (at +15 V, for example), and the third pixel transistor TR3 is controlled to be turned on. As a result, the first, the second, and the third pixel transistors TR1, TR2, and TR3 are placed in the off state after the writing period, whereby it is possible to prevent the second pixel transistor TR2 and the third pixel transistor TR3 from being simultaneously placed in the on state.

Third Embodiment

Figure 13:
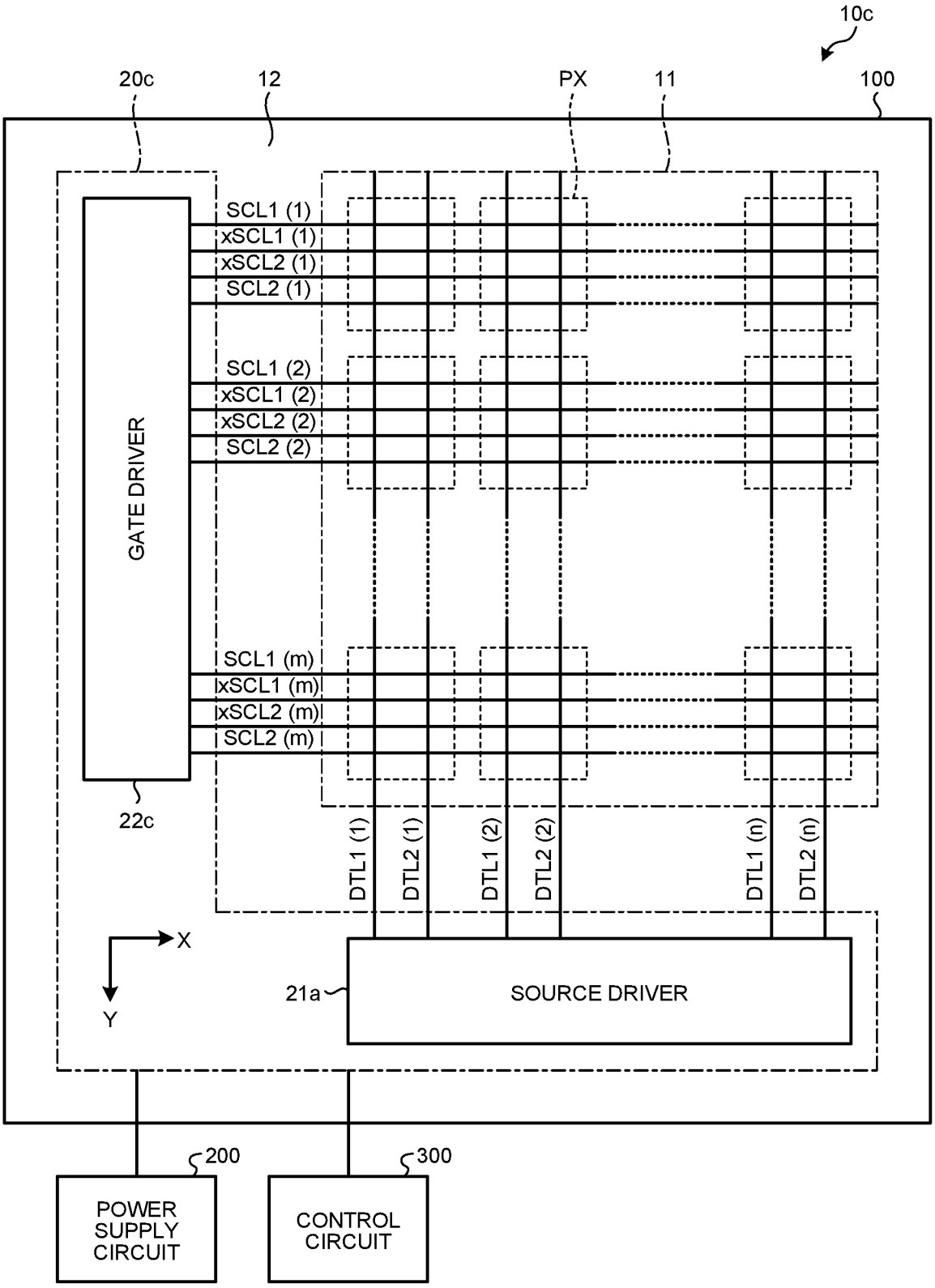
FIG. 13 is a block diagram illustrating a configuration example of a display device according to a third embodiment.
Figure 14:
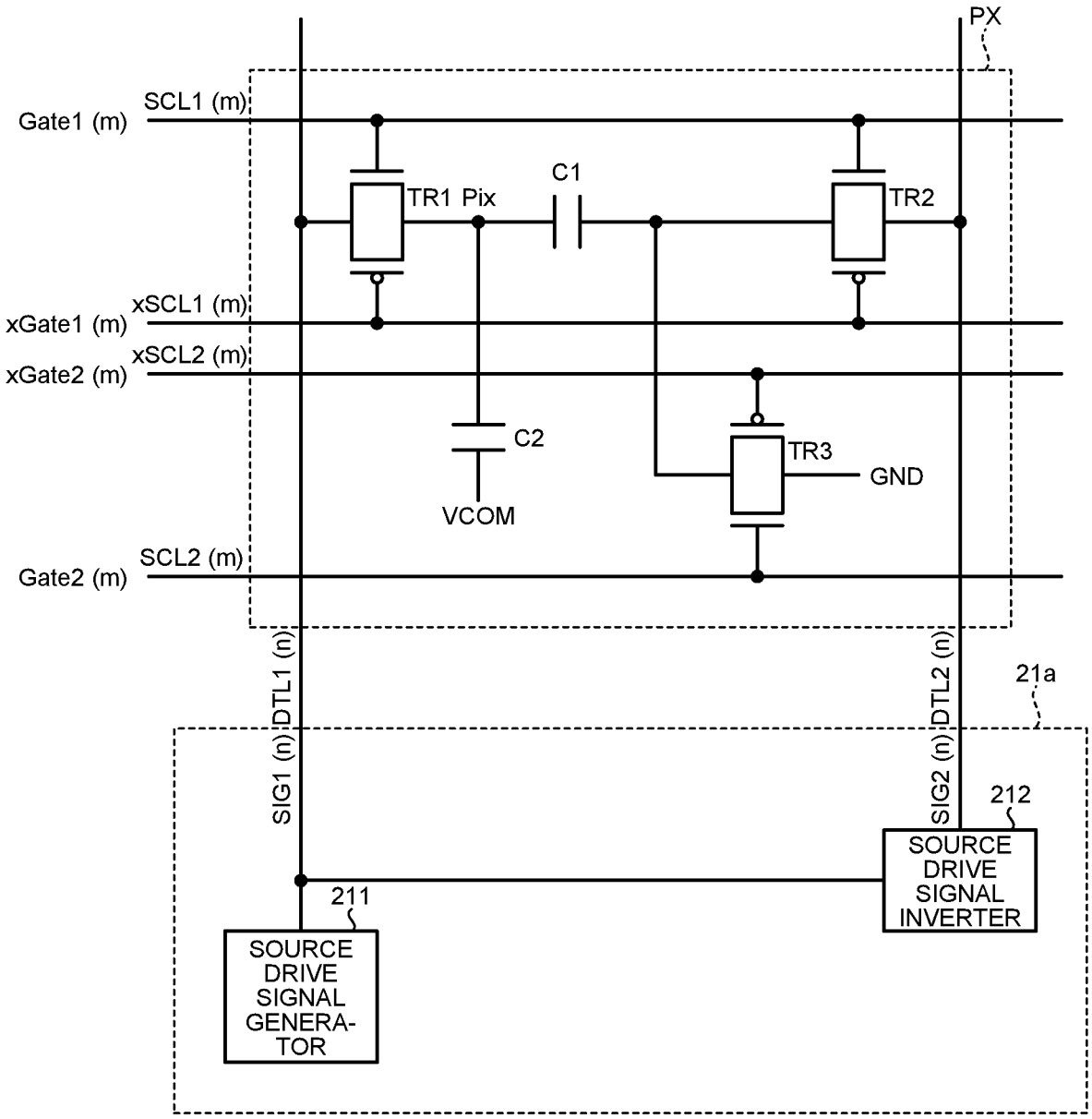
FIG. 14 is a diagram illustrating an exemplary configuration of one pixel and an exemplary internal configuration of the source driver in the display device according to the third embodiment.
Figure 15A:
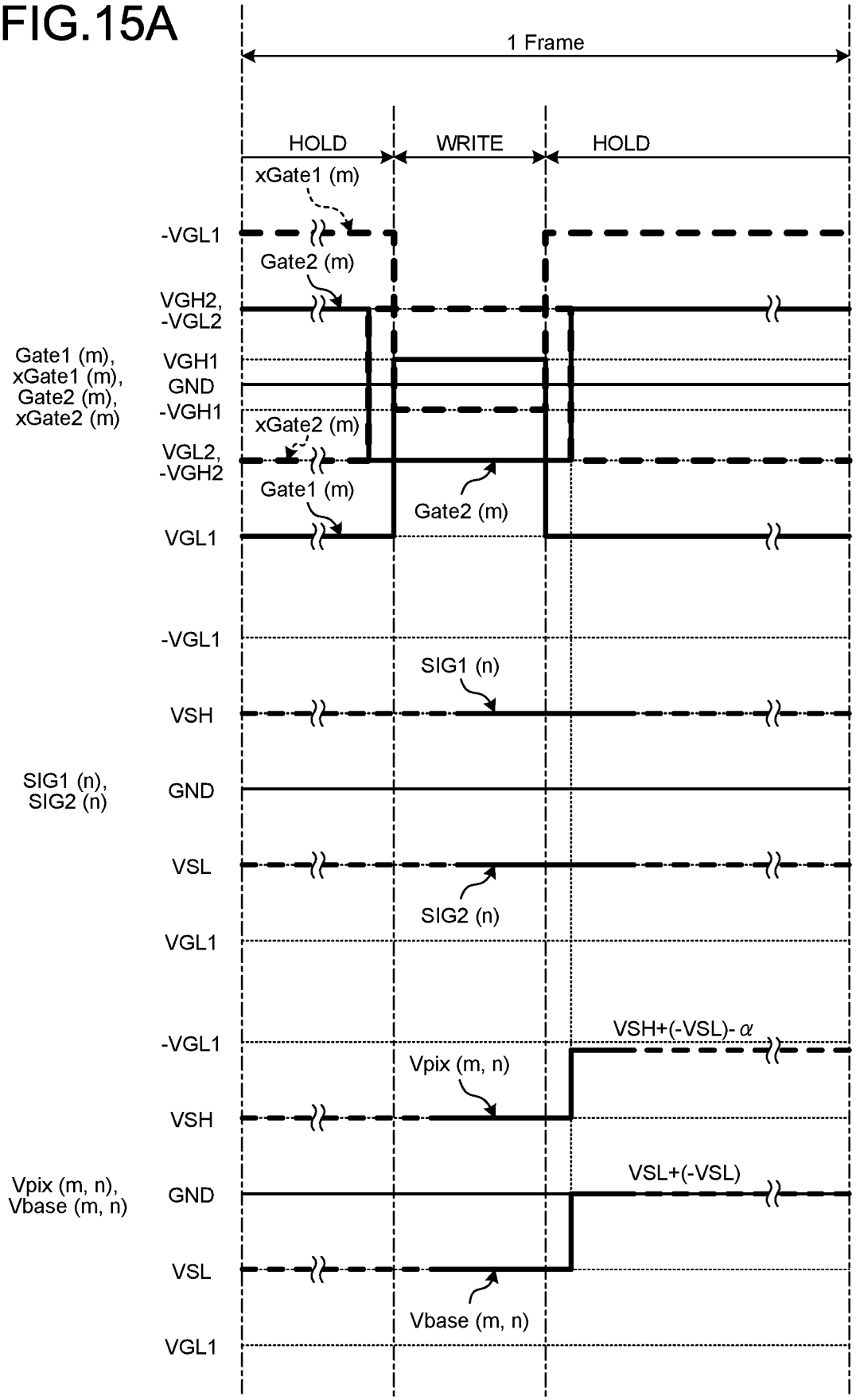
FIG. 15A is a timing diagram for explaining an operation in the third embodiment.
Figure 15B:
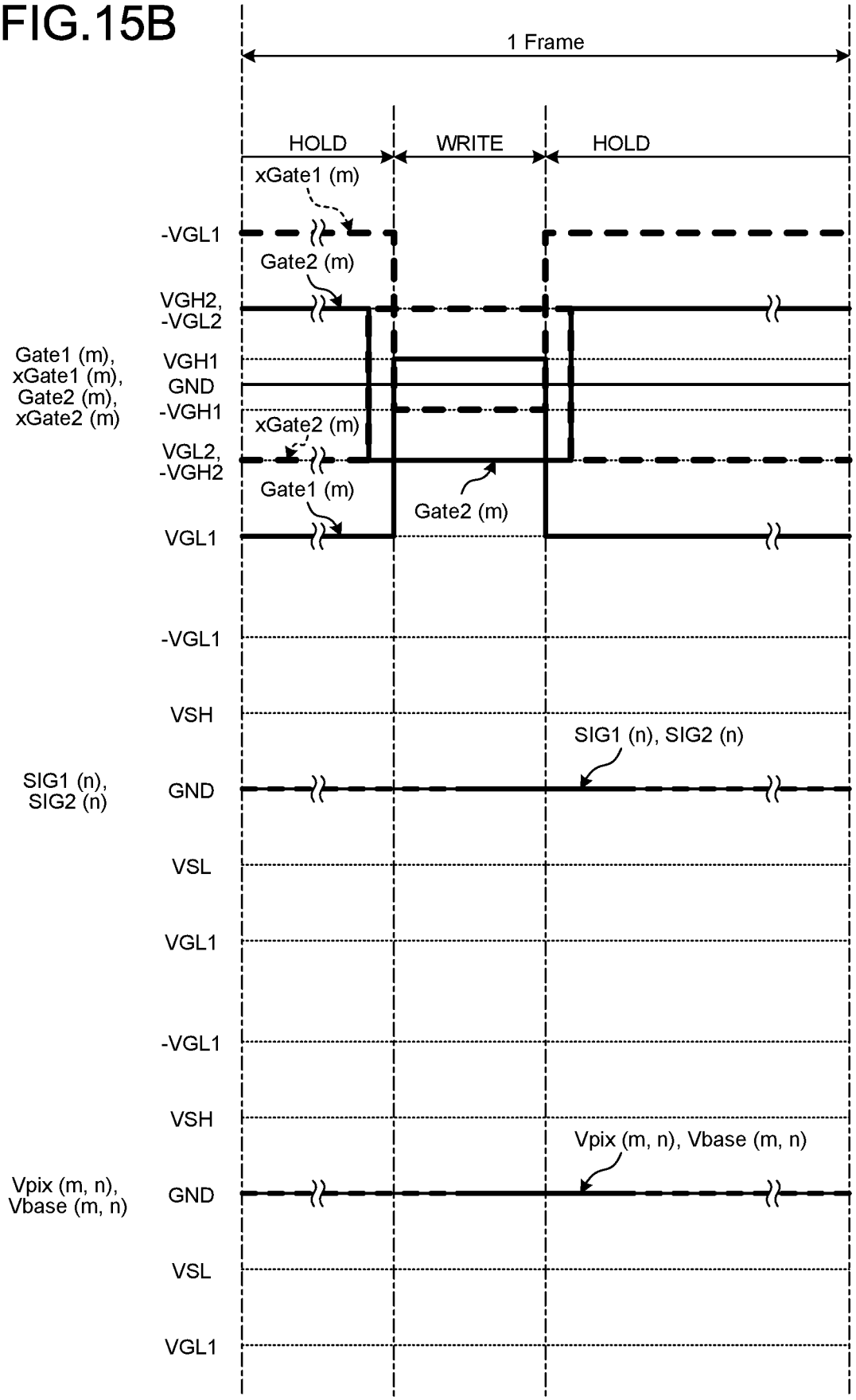
FIG. 15B is a timing diagram for explaining another operation in the third embodiment.
Figure 15C:
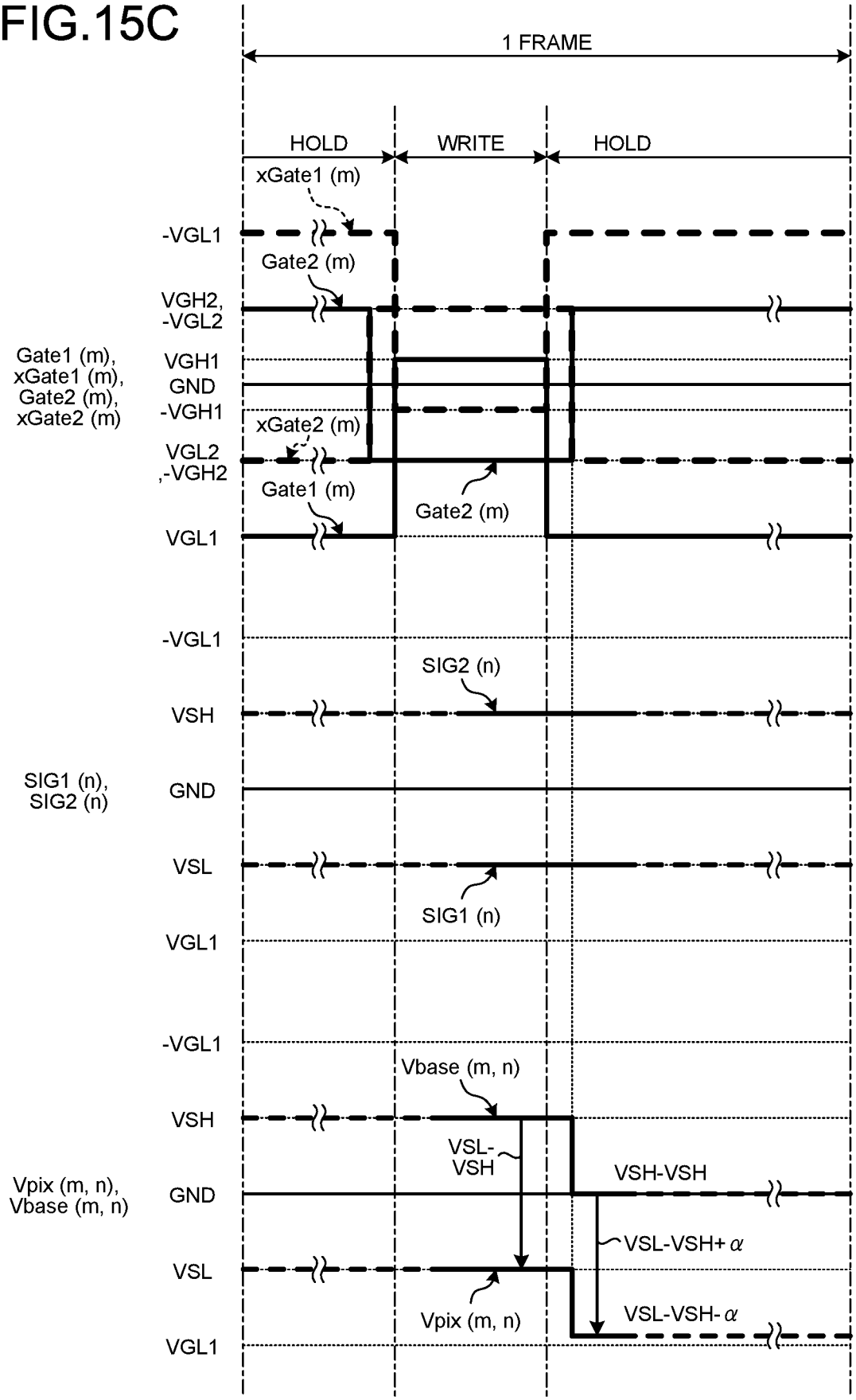
FIG. 15C is a timing diagram for explaining still another operation in the third embodiment.

FIG. 13 is a block diagram illustrating a configuration example of a display device according to a third embodiment. FIG. 14 is a diagram illustrating an exemplary configuration of one pixel and an exemplary internal configuration of the source driver in the display device according to the third embodiment. FIGS. 15A, 15B, and 15C are timing diagrams for explaining operations in the third embodiment. In the following description, the same components as those described in either of the first and the second embodiments above will be denoted by the same reference numerals, the repetitive explanation thereof will be omitted, and only differences from the first and the second embodiments will be described.

In a display device 10*c* according to the third embodiment, the first, the second, and the third pixel transistors TR1, TR2, and TR3 of the pixel PX according to the third embodiment coupled to the display panel driver 20*c* each have a complementary metal-oxide semiconductor (CMOS) configuration obtained by combining a PMOS transistor with an NMOS transistor, as illustrated in FIG. 14.

A gate driver 22*c* of the display panel driver 20*c* is electrically coupled to the pixels PX arranged in the X-direction in the display region 11 through the first gate bus line (first scan line) SCL1(m) and transmits the first gate drive signal (first scan signal) Gate1(m) to the first gate bus line (first scan line) SCL1(m). The gate driver 22*c* supplies the first positive gate potential VGH1 to the first gate bus line (first scan line) SCL1(m) during the writing period. The gate driver 22*c* supplies the first negative gate potential VGL1 to the first gate bus line (first scan line) SCL1(m) during the holding period. In the present embodiment, the first positive gate potential VGH1 is set to +5 V, for example. In the present embodiment, the first negative gate potential VGL1 is set to −34 V, for example.

The gate driver 22*c* is also electrically coupled to the pixels PX arranged in the X-direction in the display region 11 through the second gate bus line (second scan line) SCL2(m) and transmits the second gate drive signal (second scan signal) Gate2(m) to the second gate bus line (second scan line) SCL2(m). The gate driver 22*c* supplies the second negative gate potential VGL2 to the second gate bus line (second scan line) SCL2(m) during the writing period. The gate driver 22*c* supplies the second positive gate potential VGH2 to the second gate bus line (second scan line) SCL2(m) during the holding period. In the present embodiment, the second negative gate potential VGL2 is set to −15 V, for example. In the present embodiment, the second positive gate potential VGH2 is set to +15 V, for example.

The gate driver 22*c* is also electrically coupled to the pixels PX arranged in the X-direction in the display region 11 through a third gate bus line (third scan line) xSCL1(m) and transmits a third gate drive signal (third scan signal) xGate1(m) to the third gate bus line (third scan line) xSCL1(m). The gate driver 22*c* supplies a third negative gate potential −VGH1 to the third gate bus line (third scan line) xSCL1(m) during the writing period. The gate driver 22*c* supplies a third positive gate potential −VGL1 to the third gate bus line (third scan line) xSCL1(m) during the holding period. In the present embodiment, the third negative gate potential −VGH1 is set to −5 V, for example. In the present embodiment, the third positive gate potential −VGL1 is set to +34 V, for example.

The gate driver 22*c* is also electrically coupled to the pixels PX arranged in the X-direction in the display region 11 through a fourth gate bus line (fourth scan line) xSCL2(m) and transmits a fourth gate drive signal (fourth scan signal) xGate2(m) to the fourth gate bus line (fourth scan line) xSCL2(m). The gate driver 22*c* supplies a fourth negative gate potential −VGH2 to the fourth gate bus line (fourth scan line) xSCL2(m) during the writing period. The gate driver 22*c* supplies a fourth positive gate potential −VGL2 to the fourth gate bus line (fourth scan line) xSCL2(m) during the holding period. In the present embodiment, the fourth negative gate potential −VGH2 is set to −15 V, for example. In the present embodiment, the fourth positive gate potential −VGL2 is set to +15 V, for example.

As illustrated in FIG. 14, in the pixel PX according to the third embodiment, the first gate bus line (first scan line) SCL1(m) is coupled to the gate of the NMOS transistor of the first pixel transistor TR1, and the third gate bus line (third scan line) xSCL1(m) is coupled to the gate of the PMOS transistor of the first pixel transistor TR1. The first gate bus line (first scan line) SCL1(m) is coupled to the gate of the NMOS transistor of the second pixel transistor TR2, and the third gate bus line (third scan line) xSCL1(m) is coupled to the gate of the PMOS transistor of the second pixel transistor TR2. The second gate bus line (second scan line) SCL2(m) is coupled to the gate of the NMOS transistor of the third pixel transistor TR3, and the fourth gate bus line (fourth scan line) xSCL2(m) is coupled to the gate of the PMOS transistor of the third pixel transistor TR3.

As illustrated in FIG. 15A, when the first source bus line (first signal line) DTL1(n) is supplied with the positive source potential VSH (at +15 V, for example), that is, when the first source drive signal (first pixel signal) SIG1(n) is set to the positive source potential VSH, the second source bus line (second signal line) DTL2(n) is supplied with the negative source potential VSL (at −15 V, for example). That is, the second source drive signal (second pixel signal) SIG2(n) is set to the negative source potential VSL.

In the holding period, when the first gate bus line (first scan line) SCL1(m) is supplied with the first negative gate potential VGL1 (at −34 V, for example) and the third gate bus line (third scan line) xSCL1(m) is supplied with the third positive gate potential −VGL1 (at +34 V, for example), the first and the second pixel transistors TR1 and TR2 are controlled to be turned off. When the second gate bus line (second scan line) SCL2(m) is supplied with the second negative gate potential VGL2 (at −15 V, for example) and the fourth gate bus line (fourth scan line) xSCL2(m) is supplied with the fourth positive gate potential −VGL2 (at +15 V, for example) before the writing period, the third pixel transistor TR3 is controlled to be turned off. As a result, the first, the second, and the third pixel transistors TR1, TR2, and TR3 are placed in the off state. In the writing period, when the first gate bus line (first scan line) SCL1(m) is supplied with the first positive gate potential VGH1 (at +5 V, for example) and the third gate bus line (third scan line) xSCL1(m) is supplied with the third negative gate potential −VGH1 (at −5 V, for example), the first and the second pixel transistors TR1 and TR2 are controlled to be turned on. As a result, the positive source potential VSH is applied as the potential Vpix(m, n) onto the pixel electrode Pix side of the first holding capacitance C1, and the negative source potential VSL is applied as the potential Vbase(m, n) onto the other side different from the pixel electrode Pix side of the first holding capacitance C1. As a result, the first holding capacitance C1 is charged by the difference VSH−VSL between the positive source potential VSH and the negative source potential VSL (at +15 V−(−15 V)=30 V, for example).

In the holding period following the writing period, when the first gate bus line (first scan line) SCL1(m) is supplied with the first negative gate potential VGL1 (at −34 V, for example) and the third gate bus line (third scan line) xSCL1(m) is supplied with the third positive gate potential −VGL1 (at +34 V, for example), the first and the second pixel transistors TR1 and TR2 are controlled to be turned off. As a result, the first, the second, and the third pixel transistors TR1, TR2, and TR3 are placed in the off state. After the holding period has started, when the second gate bus line (second scan line) SCL2(m) is supplied with the second positive gate potential VGH2 (at +15 V, for example) and the fourth gate bus line (fourth scan line) xSCL2(m) is supplied with the fourth negative gate potential −VGH2 (at −15 V, for example), the third pixel transistor TR3 is controlled to be turned on. This operation applies the GND potential as the potential Vbase(m, n) onto the other side different from the pixel electrode Pix side of the first holding capacitance C1. As a result, the potential Vpix(m, n) of the pixel electrode Pix is increased to VSH+(−VSL)−α (for example, +15 V+(−(−15 V))−α=30 V−α) by voltage dividing between the first holding capacitance C1 and the second holding capacitance C2. Thus, the potential Vpix(m, n) of the pixel electrode Pix is held at VSH+(−VSL)−α (for example, +15 V+(−(−15 V))−α=30 V−α) during the holding period.

As illustrated in FIG. 15B, when the first source bus line (first signal line) DTL1(n) is supplied with the GND potential (at 0 V), that is, when the first source drive signal (first pixel signal) SIG1(n) is set to the GND potential, the second source bus line (second signal line) DTL2(n) is supplied with the GND potential (at 0 V). That is, the second source drive signal (second pixel signal) SIG2(n) is set to the GND potential.

In the holding period, when the first gate bus line (first scan line) SCL1(m) is supplied with the first negative gate potential VGL1 (at −34 V, for example) and the third gate bus line (third scan line) xSCL1(m) is supplied with the third positive gate potential −VGL1 (at +34 V, for example), the first and the second pixel transistors TR1 and TR2 are controlled to be turned off. When the second gate bus line (second scan line) SCL2(m) is supplied with the second negative gate potential VGL2 (at −15 V, for example) and the fourth gate bus line (fourth scan line) xSCL2(m) is supplied with the fourth positive gate potential −VGL2 (at +15 V, for example) before the writing period, the third pixel transistor TR3 is controlled to be turned off. As a result, the first, the second, and the third pixel transistors TR1, TR2, and TR3 are placed in the off state. In the writing period, when the first gate bus line (first scan line) SCL1(m) is supplied with the first positive gate potential VGH1 (at +5 V, for example) and the third gate bus line (third scan line) xSCL1(m) is supplied with the third negative gate potential −VGH1 (at −5 V, for example), the first and the second pixel transistors TR1 and TR2 are controlled to be turned on. This operation applies the GND potential as the potential Vbase (m, n) onto the other side different from the pixel electrode Pix side of the first holding capacitance C1. As a result, the GND potential is applied as the potential Vpix(m, n) onto the pixel electrode Pix side of the first holding capacitance C1, and the GND potential is applied as the potential Vbase(m, n) onto the other side different from the pixel electrode Pix side of the first holding capacitance C1. As a result, the voltage between both ends of the first holding capacitance C1 is set to 0 V.

In the holding period following the writing period, when the first gate bus line (scan line) SCL1(m) is supplied with the first negative gate potential VGL1 (at −34 V, for example) and the third gate bus line (scan line) xSCL1(m) is supplied with the third positive gate potential −VGL1 (at +34 V, for example), the first and the second pixel transistors TR1 and TR2 are controlled to be turned off. As a result, the first, the second, and the third pixel transistors TR1, TR2, and TR3 are placed in the off state. After the holding period has started, when the second gate bus line (second scan line) SCL2(m) is supplied with the second positive gate potential VGH2 (at +15 V, for example) and the fourth gate bus line (fourth scan line) xSCL2(m) is supplied with the fourth negative gate potential −VGH2 (at −15 V, for example), the third pixel transistor TR3 is controlled to be turned on. This operation applies the GND potential as the potential Vbase (m, n) onto the other side different from the pixel electrode Pix side of the first holding capacitance C1. Thus, the potential Vpix(m, n) of the pixel electrode Pix is held at 0 V, that is, at the GND potential during the holding period.

As illustrated in FIG. 15C, when the first source bus line (first signal line) DTL1(n) is supplied with the negative source potential VSL (at −15 V, for example), that is, when the first source drive signal (first pixel signal) SIG1(n) is set to the negative source potential VSL, the second source bus line (second signal line) DTL2(n) is supplied with the positive source potential VSH (at +15 V, for example). That is, the second source drive signal (second pixel signal) SIG2(n) is set to the positive source potential VSH.

In the holding period, when the first gate bus line (first scan line) SCL1(m) is supplied with the first negative gate potential VGL1 (at −34 V, for example) and the third gate bus line (third scan line) xSCL1(m) is supplied with the third positive gate potential −VGL1 (at +34 V, for example), the first and the second pixel transistors TR1 and TR2 are controlled to be turned off. When the second gate bus line (second scan line) SCL2(m) is supplied with the second negative gate potential VGL2 (at −15 V, for example) and the fourth gate bus line (fourth scan line) xSCL2(m) is supplied with the fourth positive gate potential −VGL2 (at +15 V, for example) before the writing period, the third pixel transistor TR3 is controlled to be turned off. As a result, the first, the second, and the third pixel transistors TR1, TR2, and TR3 are placed in the off state. In the writing period, when the first gate bus line (first scan line) SCL1(m) is supplied with the first positive gate potential VGH1 (at +5 V, for example) and the third gate bus line (third scan line) xSCL1(m) is supplied with the third negative gate potential −VGH1 (at −5 V, for example), the first and the second pixel transistors TR1 and TR2 are controlled to be turned on. As a result, the negative source potential VSL is applied as the potential Vpix(m, n) onto the pixel electrode Pix side of the first holding capacitance C1, and the positive source potential VSH is applied as the potential Vbase(m, n) onto the other side different from the pixel electrode Pix side of the first holding capacitance C1. As a result, the first holding capacitance C1 is charged by the difference VSL−VSH between the negative source potential VSL and the positive source potential VSH (at −15 V−15 V=−30 V, for example).

In the holding period following the writing period, when the first gate bus line (first scan line) SCL1(m) is supplied with the first negative gate potential VGL1 (at −34 V, for example) and the third gate bus line (third scan line) xSCL1(m) is supplied with the third positive gate potential −VGL1 (at +34 V, for example), the first and the second pixel transistors TR1 and TR2 are controlled to be turned off. As a result, the first, the second, and the third pixel transistors TR1, TR2, and TR3 are placed in the off state. After the holding period has started, when the second gate bus line (second scan line) SCL2(m) is supplied with the second positive gate potential VGH2 (at +15 V, for example) and the fourth gate bus line (fourth scan line) xSCL2(m) is supplied with the fourth negative gate potential −VGH2 (at −15 V, for example), the third pixel transistor TR3 is controlled to be turned on. This operation applies the GND potential as the potential Vbase(m, n) onto the other side different from the pixel electrode Pix side of the first holding capacitance C1. As a result, the potential Vpix(m, n) of the pixel electrode Pix is increased to VSL−VSH+α (for example, −15 V−15 V+α=−30 V+α) by the voltage dividing between the first holding capacitance C1 and the second holding capacitance C2. Thus, the potential Vpix(m, n) of the pixel electrode Pix is held at VSL−VSH+α (for example, −15 V−15 V+α=−30 V+α) during the holding period.

Thus, with the configuration of the third embodiment, when the second gate bus line (second scan line) SCL2(m) is supplied with the second negative gate potential VGL2 (at −15 V, for example) and the fourth gate bus line (fourth scan line) xSCL2(m) is supplied with the fourth positive gate potential −VGL2 (at +15 V, for example) before the writing period, the third pixel transistor TR3 is controlled to be turned off. As a result, in the same manner as in the second embodiment, the first, the second, and the third pixel transistors TR1, TR2, and TR3 are placed in the off state before the writing period, whereby it is possible to prevent the second pixel transistor TR2 and the third pixel transistor TR3 from being simultaneously placed in the on state.

When the second gate bus line (second scan line) SCL2 (m) is supplied with the second positive gate potential VGH2 (at +15 V, for example) and the fourth gate bus line (fourth scan line) xSCL2(m) is supplied with the fourth negative gate potential −VGH2 (at −15 V, for example) after the holding period has started, the third pixel transistor TR3 is controlled to be turned on. As a result, in the same manner as in the second embodiment, the first, the second, and the third pixel transistors TR1, TR2, and TR3 are placed in the off state after the writing period, whereby it is possible to prevent the second pixel transistor TR2 and the third pixel transistor TR3 from being simultaneously placed in the on state.

In the configuration of the third embodiment, the first, the second, and the third pixel transistors TR1, TR2, and TR3 each have a CMOS configuration obtained by combining a PMOS transistor with an NMOS transistor. This configuration enables driving at a lower voltage than in the first and the second embodiments described above. As a result, the display IC and the TFT substrate 100 can have a still lower withstand voltage and thus can further contribute to reduction in cost and improvement in reliability.

Each of the embodiments described above can provide a display device that can achieve a lower withstand voltage and can achieve lower cost and improved reliability.

The components in the embodiments described above can be combined as appropriate. Other operational advantages accruing from the aspects described in the embodiments of the present disclosure that are obvious from the description herein, or that are conceivable as appropriate by those skilled in the art will naturally be understood as accruing from the embodiments of the present disclosure.

What is claimed is:

1. A display device having a writing period of charging holding capacitance in a pixel and a holding period of holding the holding capacitance charged in the writing period, the display device comprising:

a first pixel transistor configured to electrically couple one electrode of the holding capacitance to a first signal line;

a second pixel transistor configured to electrically couple another electrode of the holding capacitance to a second signal line;

a third pixel transistor configured to electrically couple the other electrode of the holding capacitance to a ground (GND) potential; and a driver configured to supply one of a positive potential, the GND potential, and a negative potential to the first signal line and the second signal line, wherein the driver is configured to:

supply the negative potential to the second signal line when the first signal line is supplied with the positive potential;

supply the GND potential to the second signal line when the first signal line is supplied with the GND potential; and supply the positive potential to the second signal line when the first signal line is supplied with the negative potential, the first pixel transistor and the second pixel transistor are configured to be placed in an on state during the writing period and placed in an off state during the holding period, and the third pixel transistor is configured to be placed in the off state during the writing period and placed in the on state during the holding period.

2. The display device according to claim 1, wherein the first pixel transistor and the second pixel transistor are each an n-channel metal oxide semiconductor (NMOS) transistor, the third pixel transistor is a p-channel metal oxide semiconductor (PMOS) transistor, and a gate of the first pixel transistor, a gate of the second pixel transistor, and a gate of the third pixel transistor are coupled to a scan line to which the positive potential is applied during the writing period and the negative potential is applied during the holding period.

3. The display device according to claim 1, wherein the first pixel transistor, the second pixel transistor, and the third pixel transistor are each an n-channel metal oxide semiconductor (NMOS) transistor, a gate of the first pixel transistor and a gate of the second pixel transistor are coupled to a first scan line to which a first positive potential is applied during the writing period and a first negative potential is applied during the holding period, and a gate of the third pixel transistor is coupled to a second scan line to which a second negative potential smaller than the first negative potential is applied during the writing period and a second positive potential smaller than the first positive potential is applied during the holding period.

4. The display device according to claim 1, wherein the first pixel transistor, the second pixel transistor, and the third pixel transistor are each a transistor having a complementary metal-oxide semiconductor (CMOS) configuration obtained by combining a p-channel metal oxide semiconductor (PMOS) transistor with an n-channel metal oxide semiconductor (NMOS) transistor.

5. The display device according to claim 4, wherein a gate of the NMOS transistor of the first pixel transistor and a gate of the NMOS transistor of the second pixel transistor are coupled to a first scan line to which a first positive potential is applied during the writing period and a first negative potential is applied during the holding period, a gate of the NMOS transistor of the third pixel transistor is coupled to a second scan line to which a second negative potential smaller than the first negative potential is applied during the writing period and a second positive potential smaller than the first positive potential is applied during the holding period, a gate of the PMOS transistor of the first pixel transistor and a gate of the PMOS transistor of the second pixel transistor are coupled to a third scan line to which a third negative potential is applied during the writing period and a third positive potential is applied during the holding period, and a gate of the PMOS transistor of the third pixel transistor is coupled to a fourth scan line to which a fourth negative potential is applied during the writing period and a fourth positive potential is applied during the holding period.

6. The display device according to claim 3, wherein the third pixel transistor is configured to:

be controlled to be turned off before the first pixel transistor and the second pixel transistor are controlled to be turned on; and be controlled to be turned on after the first pixel transistor and the second pixel transistor are controlled to be turned off.

7. The display device according to claim 4, wherein the third pixel transistor is configured to:

be controlled to be turned off before the first pixel transistor and the second pixel transistor are controlled to be turned on; and be controlled to be turned on after the first pixel transistor and the second pixel transistor are controlled to be turned off.

* * * * *